US011439894B2

(12) United States Patent
Stringham

(10) Patent No.: US 11,439,894 B2
(45) Date of Patent: Sep. 13, 2022

(54) MAGNETIC CONNECTORS AND COUPLED TRACK SEGMENTS FOR ROLLING BALLS DOWN A VERTICAL SURFACE

(71) Applicant: Bryan Stringham, Provo, UT (US)

(72) Inventor: Bryan Stringham, Provo, UT (US)

( * ) Notice: Subject to any disclaimer, the term of this patent is extended or adjusted under 35 U.S.C. 154(b) by 0 days.

(21) Appl. No.: 17/387,693

(22) Filed: Jul. 28, 2021

(65) Prior Publication Data

US 2022/0032170 A1 Feb. 3, 2022

Related U.S. Application Data

(60) Provisional application No. 63/060,549, filed on Aug. 3, 2020.

(51) Int. Cl.
*A63F 7/36* (2006.01)
*A63F 7/28* (2006.01)

(52) U.S. Cl.
CPC ..... *A63F 7/3622* (2013.01); *A63F 7/28* (2013.01); *A63F 2007/282* (2013.01); *A63F 2007/3662* (2013.01)

(58) Field of Classification Search
CPC .... A63F 7/3622; A63F 7/28; A63F 2007/282; A63F 2007/3662; A63F 2003/00406; A63F 2003/00545; G09B 23/12; A63G 33/046; A63H 18/028
See application file for complete search history.

(56) References Cited

U.S. PATENT DOCUMENTS

| | | | | |
|---|---|---|---|---|
| 1,995,786 | A | 3/1935 | Wachs | |
| 2,003,370 | A | 6/1935 | Kimball | |
| 2,838,870 | A | 6/1958 | Morse | |
| D290,143 | S * | 6/1987 | Wichman | D21/564 |
| 9,956,493 | B1 * | 5/2018 | Hunts, Jr. | A63H 33/046 |
| 2007/0209543 | A1 * | 9/2007 | Beaulieu | A63F 7/3622 104/53 |
| 2014/0206256 | A1 * | 7/2014 | Chan | A63H 19/30 446/444 |
| 2015/0298018 | A1 * | 10/2015 | Chesser | A63H 33/101 446/124 |
| 2018/0117485 | A1 | 5/2018 | Comfort | |

(Continued)

FOREIGN PATENT DOCUMENTS

| | | |
|---|---|---|
| EP | 1454662 | 9/2004 |
| WO | 0047300 | 8/2000 |

(Continued)

OTHER PUBLICATIONS

Shweka, Makeway—Create Intricate Courses, Watch Your marbles Soar, Kickstarter, <https://www.kickstarter.com/projects/makeway/makeway-create-intricate-courses-watch-your-marbles-soar>, retrieved on Jul. 27, 2021, 38 pages.

(Continued)

*Primary Examiner* — Michael D Dennis

(57) ABSTRACT

An apparatus includes a track segment including a channel for holding a rolling object, a first connector attachable to a first end of the track segment, and a second connector attachable to a second end of the track segment. Each of the first connector and the second connector include one or more magnets embedded therein that enable attaching the first connector and the second connector to a ferromagnetic surface.

7 Claims, 21 Drawing Sheets

(56) References Cited

U.S. PATENT DOCUMENTS

| | | | | |
|---|---|---|---|---|
| 2018/0236350 | A1 | 8/2018 | Johnston et al. | |
| 2019/0001232 | A1 | 1/2019 | Forgrave | |
| 2019/0255451 | A1* | 8/2019 | Paperno | A63H 33/16 |
| 2019/0374866 | A1* | 12/2019 | Welby | A63H 18/026 |
| 2020/0215423 | A1* | 7/2020 | Hauck | A63F 1/04 |

FOREIGN PATENT DOCUMENTS

| | | |
|---|---|---|
| WO | 2015118107 | 8/2015 |
| WO | 2019115400 | 6/2019 |

OTHER PUBLICATIONS

Hearthsong, Wall Coaster Ultimate Marble Run, <https://www.hearthsong.com/en/wall-coaster-ultimate-marble-run/p/1317457>, retrieved on Jul. 27, 2021, 4 pages.

Construction Junction, Magnet Marble Run, <https://www.cjreuse.org/reuse/magnet-marble-run/>, retrieved on Jul. 27, 2021, 2 pages.

Frugal Fun for Boys and Girls, Changeable Magnetic Marble Run, <https://frugalfun4boys.com/changeable-magnetic-marble-run/>, dated Oct. 16, 2014, retrieved on Jul. 27, 2021, 16 pages.

Lubbers, Wand Kugelbahn—"Wall Ball Track", <http://www.wandkugelbahn.com/>, retrieved on Jul. 27, 2021, 4 pages.

Wall Coasters, <https://www.teachersource.com/product/wall-coaster/physics-kits>, retrieved from Jul. 27, 2021, 11 pages.

Oribel, VertiPlay STEM Marble Run Learning Toy—Stick & Play Wall Toy, <https://www.amazon.com/ORIBEL-VertiPlay-Marble-Learning-Original/dp/B07YLN3JRX>, retrieved on Jul. 27, 2021, 9 pages.

Learning Resources Tumble Trax magnetic Marble Run, STEM Toy, 28 Piece Set, <https://www.amazon.com/Learning-Resources-Tumble-Magnetic-Marble/dp/B00S2XPFVQ/ref=sr_1_3?dchild=1&keywords=wall+marble+run&qid=1593458812&s=toys-and-games&sr=1-3>, retrieved on Jul. 27, 2021, 11 pages.

LAKA Frigits Deluxe, <https://www.amazon.com/Think-of-It-Frigits-Deluxe/dp/B00004TXLR/ref=cm_cr_arp_d_product_top?ie=UTF>, retrieved on Jul. 27, 2021, 8 pages.

Hot Wheels Wall Tracks—Top 10 Toys, <http://content.time.com/time/specials/packages/article/0,28804,2101344_2100678_2100676,00.html>, 2019, Time, retrieved on Jul. 27, 2021, 2 pages.

Turning Tumble, <https://www.turingtumble.com/?gclid=Cj0KCQjwoub3BRC6ARIsABGhnyZVAZ6ex2NzwM6KriP-w4EKY03ksIGdjHfq69PXBTbOSrDYibQN3saAiPNEALw_wcB>, retrieved on Jul. 27, 2021, 18 pages.

Wonderstructs, <https://wonderstructs.com/products/wonderstructs-kit?variant=5048509726752>, retrieved on Jul. 27, 2021, 3 pages.

Gravitrax, Ravensburger, <https://www.ravensburger.us/discover/gravitrax/index.html>, retrieved on Jul. 27, 2021.

Magicfly Marble Run Set, Magicfly Store, <https://www.amazon.com/Marble-Glonova-Track-Marbles-Upgrade/dp/B074M2LGDQ/ref=sr_1_2_sspa?dchild=1&keywords=marble+track&qid=1593458651&s=toys-and-games&sr=1-2-spons&psc=1&spLa=ZW5jcnlwdGVkUXVhbGlmaWVyPUEzTks3NFhNODE5VUJFJmVuY3J5cHRIZElkPUEwMDk5MDEwM1RMNVdRNzZSNUJYJmVuY3J5cHRIZEFkSWQ9QTA2MDk0NjYzODhKQVc4U0c4WFFJJndpZGdldE5hbWU9c3BfYXRmJmFjdGlvbj1jbGlja1JIZGIyZWN0JmRvTm90TG9nQ2xpY2s9dHJ1ZQ==> retrieved on Jul. 27, 2021, 6 pages.

Modular Marble Run Machine, The 3DPrintingMan, <https://www.etsy.com/listing/703836683/modular-marble-machine-marble-run?ref=pla_similar_listings_top_ad-2&plkey=df08355330d08d5b6c013c7aac5ede90e743bb5d%3A703836683&frs=1>, retrieved on Jul. 27, 2021, 8 pages.

Discovery Toys Marbleworks Marble Run Starter, <https://www.amazon.com/exec/obidos/ASIN/B003SAM6BU/ezmarbleruns-20>, retrieved on Jul. 27, 2021, 12 pages.

Wolfe Pack LLC, Modular Marble Run Coaster Cubes, Kickstarter <https://www.kickstarter.com/projects/wolfepacific/coaster-cubestm>, retrieved on Jul. 27, 2021, 19 pages.

SmartLab Toys Weird & Wacky Contraption Lab, <https://www.amazon.com/gp/product/B005AHICA8/ref=ox_sc_act_title_3?smid=ATVPDKIKX0D>, retrieved on Jul. 27, 2021, 6 pages.

Bolt—Magnetic Marble Run<https://www.educationaltoysplanet.com/magnetic-marble-run-set-stem-educational-toys-marble-maze-ga-b07x8h8mkq.html> retrieved on Jul. 28, 2021, 3 pages.

Discovery—Marble Run, <https://www.amazon.com/Discovery-Mindblown-Marble-Run-Pieces/dp/B0849T>, retrieved on Jul. 28, 2021, 3 pages.

Best Choice Products—105 Piece Kids STEM Marble Run <https://www.dealmoon.com/en/21-best-choice-products-105-piece-kids-stem-marble-run-coaster-track-toy-set/1868112.html> retrieved on Jul. 28, 2021, 1 page.

Kleiners—GULA Magnetic Marble Run, <https://www.etsy.com/listing/193681767/10-parts-kitgulamagnetic-marble> retrieved on Jul. 28, 2021, 1 page.

3dimensionCo—Marble Run Game Magnetic STL files for 3D printing, <https://www.etsy.com/listing/790188225/marble-run-game-magnetic-stl-files-only?ga_order=most_relevant&ga_search_type=all&ga_view_type=gallery&ga_search_query=marble+run&ref=sr_gallery-2-10> retrieved on Jul. 28, 2021, 1 page.

* cited by examiner

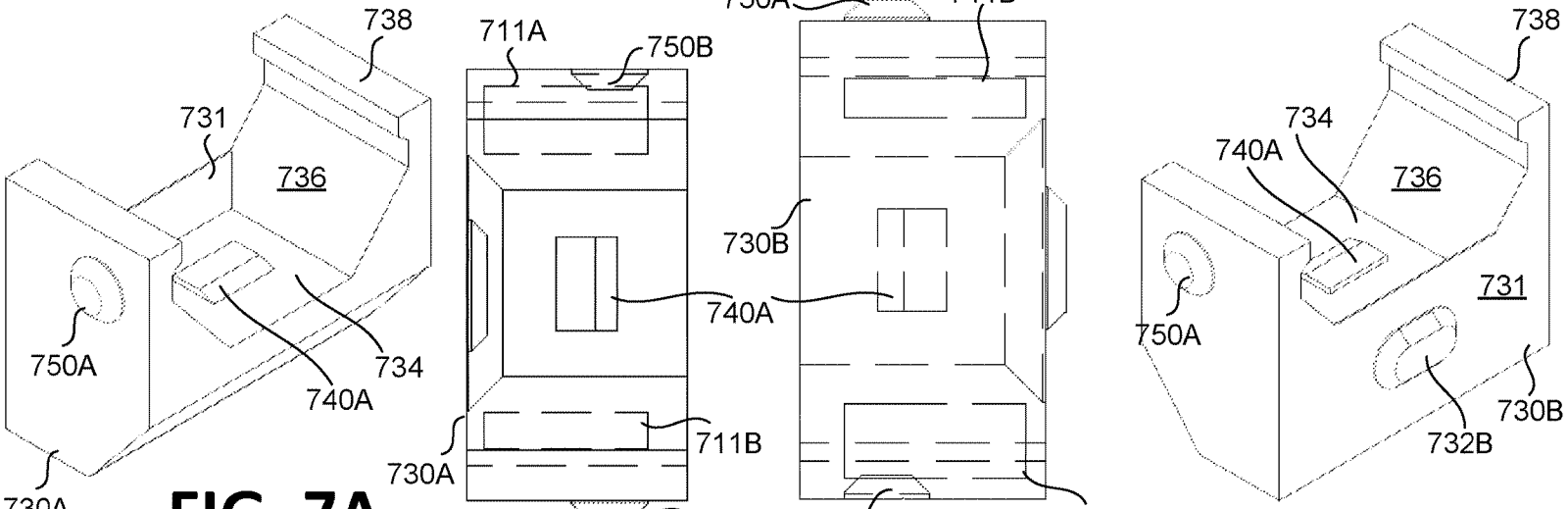
FIG. 7A
FIG. 7B
FIG. 7D
FIG. 7E
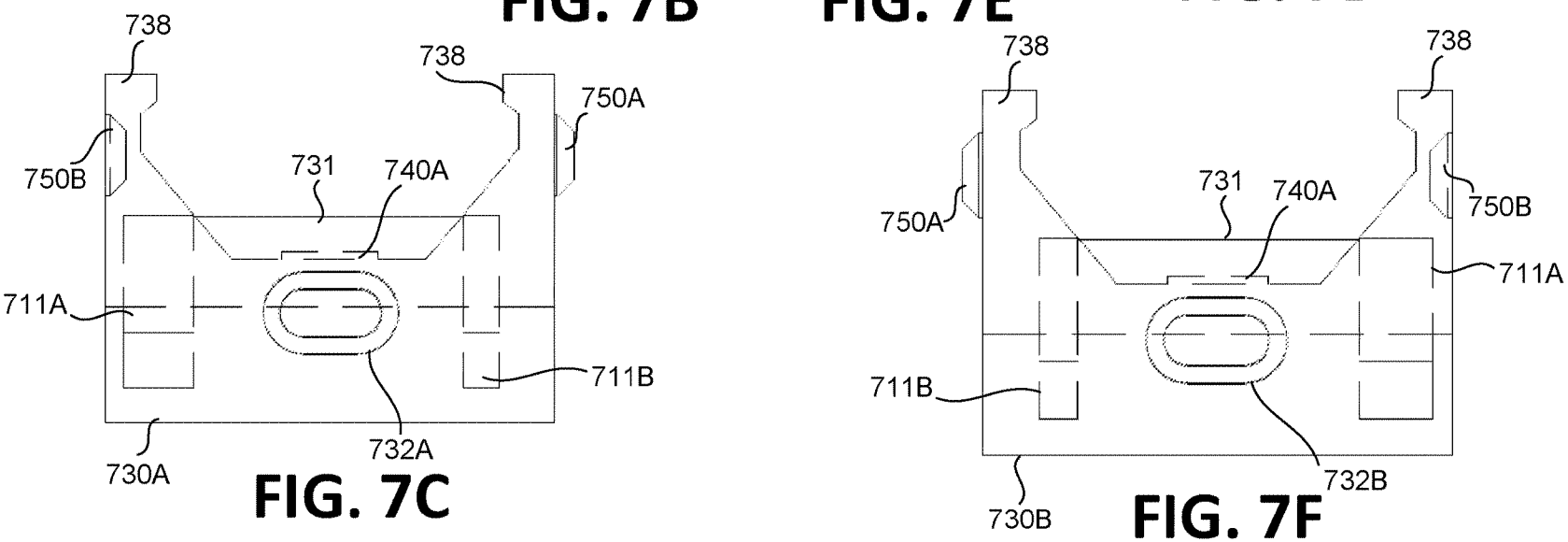
FIG. 7C
FIG. 7F

1200

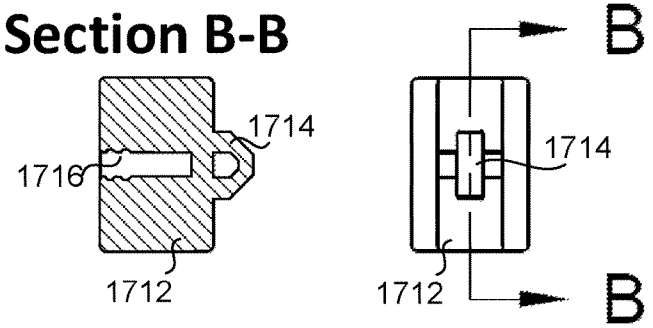
FIG. 17C
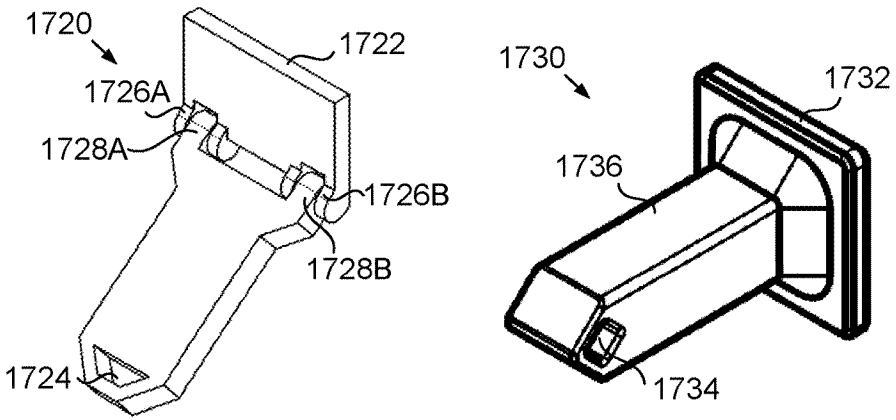
FIG. 17E
FIG. 17D
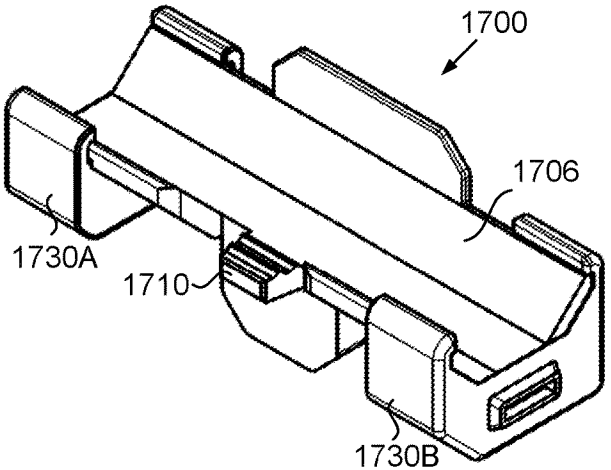
FIG. 17A
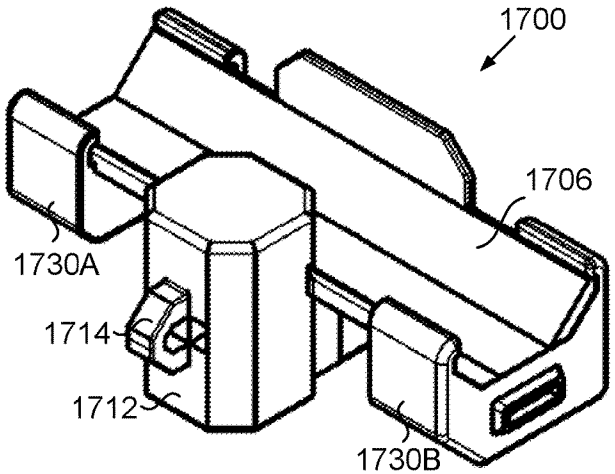
FIG. 17B

MAGNETIC CONNECTORS AND COUPLED TRACK SEGMENTS FOR ROLLING BALLS DOWN A VERTICAL SURFACE

REFERENCE TO EARLIER FILED APPLICATION

This application claims the benefit under 35 U.S.C. § 119(e) of U.S. Provisional Patent Application No. 63/060,549, filed Aug. 3, 2020, which is incorporated herein, in its entirety, by this reference.

TECHNICAL FIELD

Embodiments of the disclosure relate generally to modular wall tracks, and more specifically, related to magnetic connectors and coupled track segments for rolling balls down a vertical surface.

BACKGROUND

Tracks for balls (such as marbles) and for cars exist in the market, some that are standalone assemblies that can be placed on the floor and others that are wall mounted. Many of the latter, however, are flimsy, difficult to manufacture inexpensively while making a durable product, or are designed such that the ball often flies off the track.

BRIEF DESCRIPTION OF THE DRAWINGS

A more particular description of the disclosure briefly described above will be rendered by reference to the appended drawings, where like components will be similarly numbered. Understanding that these drawings only provide information concerning typical embodiments and are not therefore to be considered limiting of its scope, the disclosure will be described and explained with additional specificity and detail through the use of the accompanying drawings.

FIGS. 7A, 7B, 7C are a perspective view and top and front see-through views, respectively, of a magnetic connector having two side magnets and to couple to a trailing end of a track segment according an embodiment.

FIGS. 7D, 7E, 7F are a perspective view and top and front see-through views, respectively, of a magnetic connector having two side magnets and to couple to a leading end of a track segment according an embodiment.

FIG. 17A is a perspective view of a light switcher track segment and a pair of magnetic connectors according to an embodiment.

FIG. 17B is a perspective view of a light switcher track segment and a pair of magnetic connectors with a light switcher dropper according to an embodiment.

FIG. 17C is a cross-section view of the light switcher dropper illustrated in FIG. 17B along Section B-B according to an embodiment.

FIG. 17D is a perspective view of a toggle switch actuator according to an embodiment.

FIG. 17E is a perspective view of a rocker switch actuator according to an embodiment.

DETAILED DESCRIPTION

Figure 1:
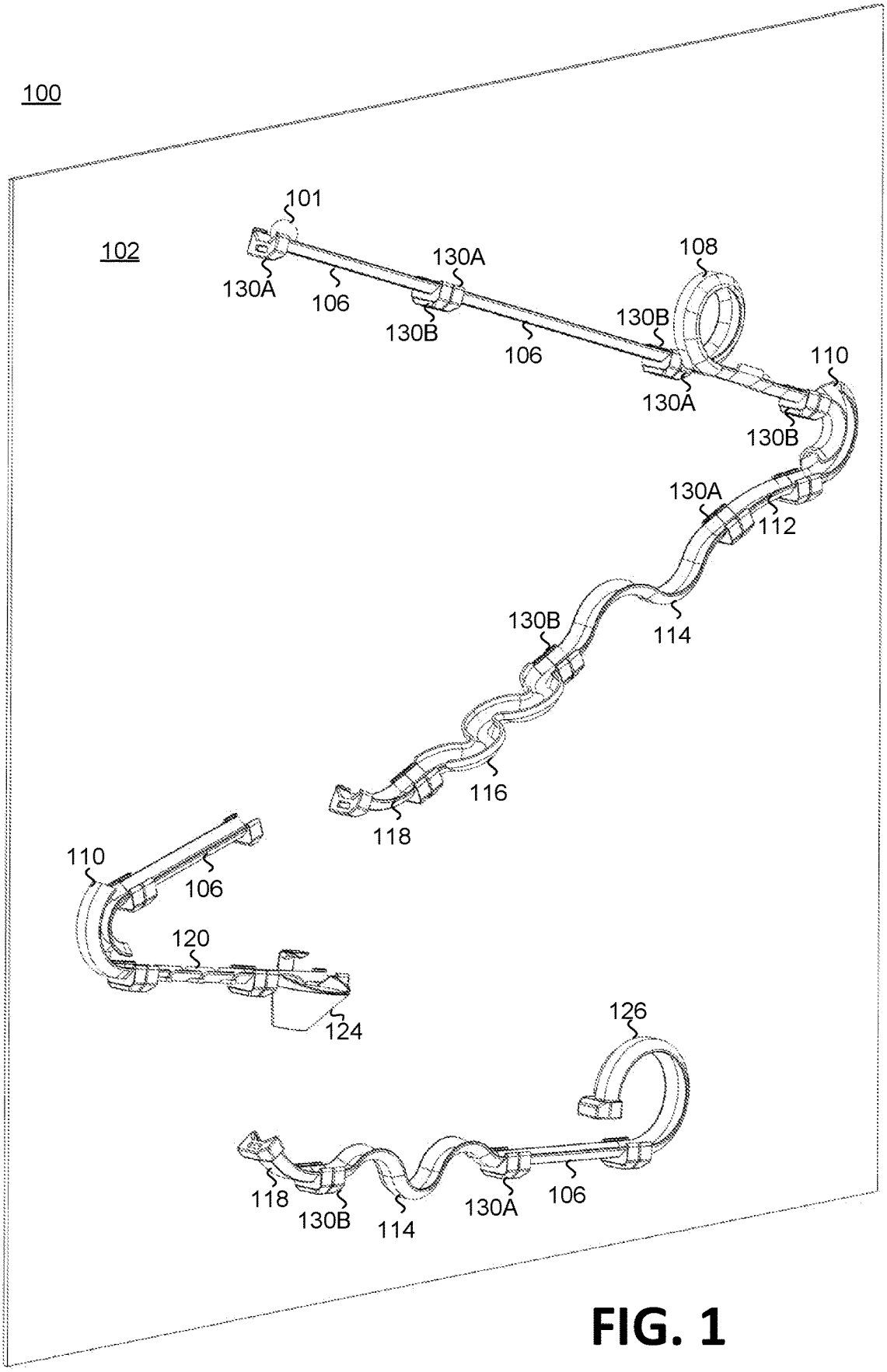
FIG. 1 is a perspective view of an example fully assembled track kit containing magnetic connectors and coupled track segments attachable to a ferromagnetic surface according to an embodiment.

By way of introduction, the present disclosure relates to modular wall tracks, and more specifically, relates to magnetic connectors and coupled track segments for rolling balls down a vertical surface. The vertical surface can be a wall, a side of furniture, or just about any vertical surface to which ferromagnetic material pieces can be adhered, whether or not metallic. A ferromagnetic material includes any material (metallic or non-metallic) to which magnets are attracted, e.g. most ferrous alloys. Disclosed modular track components can be sold in a kit and optionally partially assembled to include various types of track segments and magnetic connectors that can be coupled to one or more end of the track segments. Magnets positioned inside of the connectors enable releasably positioning the connectors against the vertical surface to position the different track segments in different combinations, as will be discussed in more detail with reference to FIG. 1. The kit can include the ferromagnetic plates to facilitate positioning the magnetic connectors to a vertical surface that is not ferromagnetic but to which the ferromagnetic plates can be adhered or otherwise attached.

In various embodiments, the track segments can be straight, other types of slides, loop-de-loop, switchbacks, funnel, snake-like, wavy, include a pegs segment, and other types of designs. By making the track segments different, the disclosed kit enables youth and adults alike to stretch their minds in assembling different track configurations, which can be used to time descent or race against another track. These track segments can be three-dimensionally (3D) printed using additive manufacturing methods, such as 3D printing, to facilitate efficient, inexpensive manufacturing of many different types of track segments, although injection molding is also envisioned and could be used in alternative embodiments.

In some embodiments, the magnetic connectors are designed to provide a consistent connection between the track segments and means of attachment to the vertical surface, e.g., with use of magnets located inside of the connectors. The connectors are sized to be much shorter than (e.g., typically no more than twenty percent (20%) although some may be as much as forty percent (40%) for shorter track pieces) the length of the track segments, thus enabling the use of a reduced track profile size along the length of the track and thus the material needed to manufacture the the track kit. Using less material means reducing the cost to manufacture the track kit.

The connectors can also be 3D printed using high-strength neodymium magnets or magnets that are inserted midway through the process of 3D printing while the printing is paused. Thus, the magnets cannot fall out and create a choking (or other health) hazard. Further, assembly time of gluing or using adhesives to affix the magnets is avoided, and the lack of adhesives enables the track components to remain clean and maintain a clean appearance without glue drops or other visual flaws.

In various embodiments, the connectors can each include one, two, or three magnets. While the single-magnet connector enables attachment to a vertical (or substantially vertical) ferromagnetic surface, the two-magnet connector enables both attachment to a ferromagnetic surface and attachment of connectors side by side to enable dual-track constructions to facilitate racing two adjacent, assembled tracks against each other. Further, a third magnet can be added behind a front surface of each magnetic connector to provide additional force of attraction between mating connectors as will be explained in more detail. Additionally, the front surface of each connector that mates to another connector can include either a male or female registry feature to facilitate interconnecting the magnetic connectors and supporting additional shear force while staying attached. The support of additional shear force enables greater resistance to movement when subjected to higher dynamic loading, e.g., fast moving or dropping ball onto a track segment.

Furthermore, in some embodiments, the magnetic connectors employ a snap fit design using a lock between each connector and a corresponding end of a track segment. In one embodiment, the lock includes a depression on an underside of the end of the track segment into which mates a protrusion located on the inside of the magnetic connector. For example, a first end of the track segment may comprise a first half of a locking mechanism and the first connector may comprise a second half of the locking mechanism that mates with the first half of the locking mechanism to lock the first connector to the track segment. In a related embodiment, the depression instead is a group of channels and the protrusion is a corresponding group of ridges that fit into the group of channels. These locking mechanisms can also enable permanent attachment of the magnetic connectors to the track segment, thus further avoiding the use of adhesives to attach the magnetic connectors to the track segments. In other embodiments, the magnetic connectors are attached to the track segments using adhesives, glues, plastic welding, melting, or the like.

The use of 3D printing to manufacture the track segments enables the production of some designs that would not be possible with injection molding even with the use of complicated injection mold undercuts and slides, e.g., funnel, loop-de-loop, switchbacks, snake with print-in-place hinges.

While there are work-arounds that could be used to manufacture similar designs, use of 3D printing makes the track segments and magnetic connectors print as a single piece with less manufacturing assembly time and results in a cleaner looking design. The above-noted and other advantages apparent to those skilled of the art will be discussed in additional detail with reference to the below Figures.

Further, the features of different embodiments can be cross-mixed with features from other, related embodiments as would be apparent to those skilled in the art. For example, the number of and location of the magnets can change, the type of and location of registry features can change, the types of track segment(s) can change, the general profile of the track can change, and the type and location of lock features can change across disclosed embodiments. Additionally, any of the track segments in any embodiment can be swapped with any other track segment in another embodiment. As features of different embodiments are cross-mixed, the need to ensure the compatibility of registry features between various connectors and the compatibility of locking features between connectors and track segments will be apparent to those skilled of the art.

FIG. 1 is a perspective view of an example fully assembled track kit 100 containing magnetic connectors and coupled track segments attachable to a ferromagnetic material surface according to an embodiment. While a number of track components are illustrated, the track kit 100 can include fewer or more components than those illustrated. In various embodiments, the track kit 100 includes a flat ferromagnetic metal sheet 102 that can be attached to a vertical surface such as a wall. The flat ferromagnetic metal sheet 102 can be made of a suitable metal such as steel or other ferromagnetic material. The flat ferromagnetic metal sheet 102 may be square or rectangular, and in one embodiment, is 28 inches by 28 inches and in another embodiment, the flat ferromagnetic metal sheet 102 is 18 inches wide by 12 inches tall.

In some embodiments, the track kit 100 also includes one or more ball 101, which can be a marble, a metal ball, or a ball made of some other material with sufficient mass to roll down the assembled track and complete any loop or other segments located therein. While a ball of ⅝ths inch is envisioned for sliding down an assembled track, different-sized balls can be used, and particularly with different-sized tracks that generally are manufactured with the principles described herein.

In various embodiments, the track kit 100 includes a number of track segments of different types, shapes, and designs. For example, the track segments can include, but not be limited to, a straight segment 106, a loop-de-loop segment 108, a switchback segment 110 (or re-direction segment), a convex segment 112, a bumpy segment 114, a wavy segment 116, a concave segment 118, a snake segment 120, a funnel segment 124, a loop segment 126, and the like. Each track segment can be configured with a cross-section design having a lower surface and slanted sidewalls extending away from the lower surface. The slanted sidewalls are to keep the ball 101 inside of the track, even under high momentum.

In various embodiments, the track kit 100 further includes a number of magnetic connectors including first connectors 130A that are (or can be) coupled to a trailing end of a track segment and second connectors 130B that are (or can be) coupled to a leading end of the track segment. The trailing end is the left-most end of the track segment and the leading end is the right most end of the track segment, as the magnets are generally located on one side of the magnetic connectors. In an alternative embodiment, where the magnets are located on the opposite side of the connectors and are placed from right to left, the trailing and leading ends may be reversed. These magnetic connectors are generally made the same and are compatible with each other so as to ubiquitously attach to any track segment type and so that each second connector 130B can mate with each first connector 130A at a transition from one track segment to another track segment. Some track kits can be manufactured with differing numbers of magnets within the magnetic connectors for different types of capabilities or function, as will be discussed in more detail.

In some embodiments, the track segments and the magnetic connectors are 3D printed as was discussed. These track components can be 3D printed using different types of polymers or other known materials used in 3D printing. The type of polymer can vary, for example, by using polylactic acid (PLA), polyethylene terephthalate glycol (PETG or PET-G), Acrylonitrile butadiene styrene (ABS), Poly-ethylene terephthalate (sometimes written poly(ethylene terephthalate)), commonly abbreviated PET (or PETE), polycarbonate, nylon, thermoplastic elastomer (TPE), thermoplastic polyurethane (TPU), thermoplastic copolyester (TPC), or woof-infused polymer. The PLA is easily produced in high quality results while also being durable and biodegradable. These other listed types of polymers are also strong and lightweight and impart various advantages in use in 3D printing.

Figure 2A:
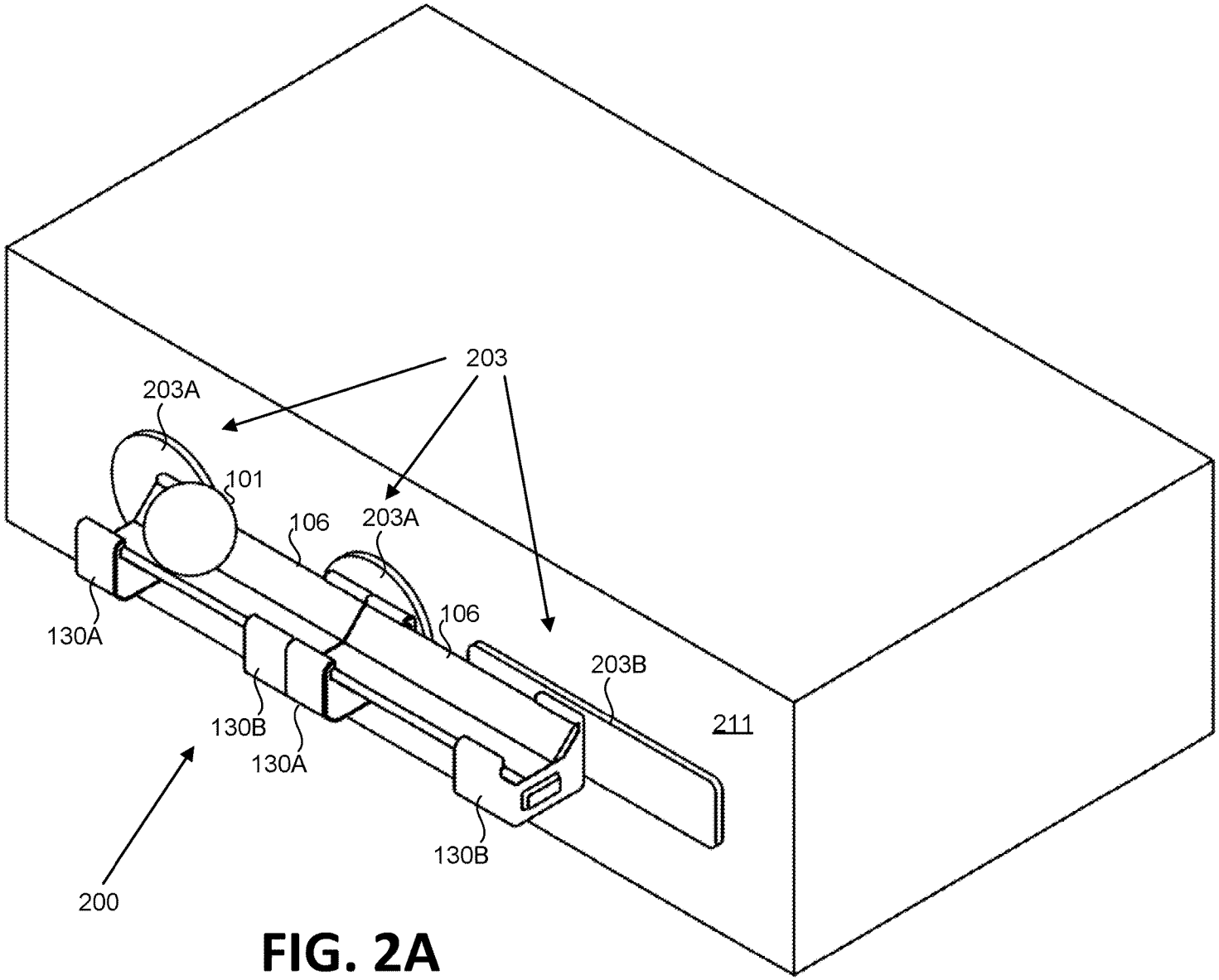
FIG. 2A is a perspective view of an assembly of track segments using magnetic connectors attached to ferromagnetic metallic plates of a track kit according to an embodiment.
Figure 2B:
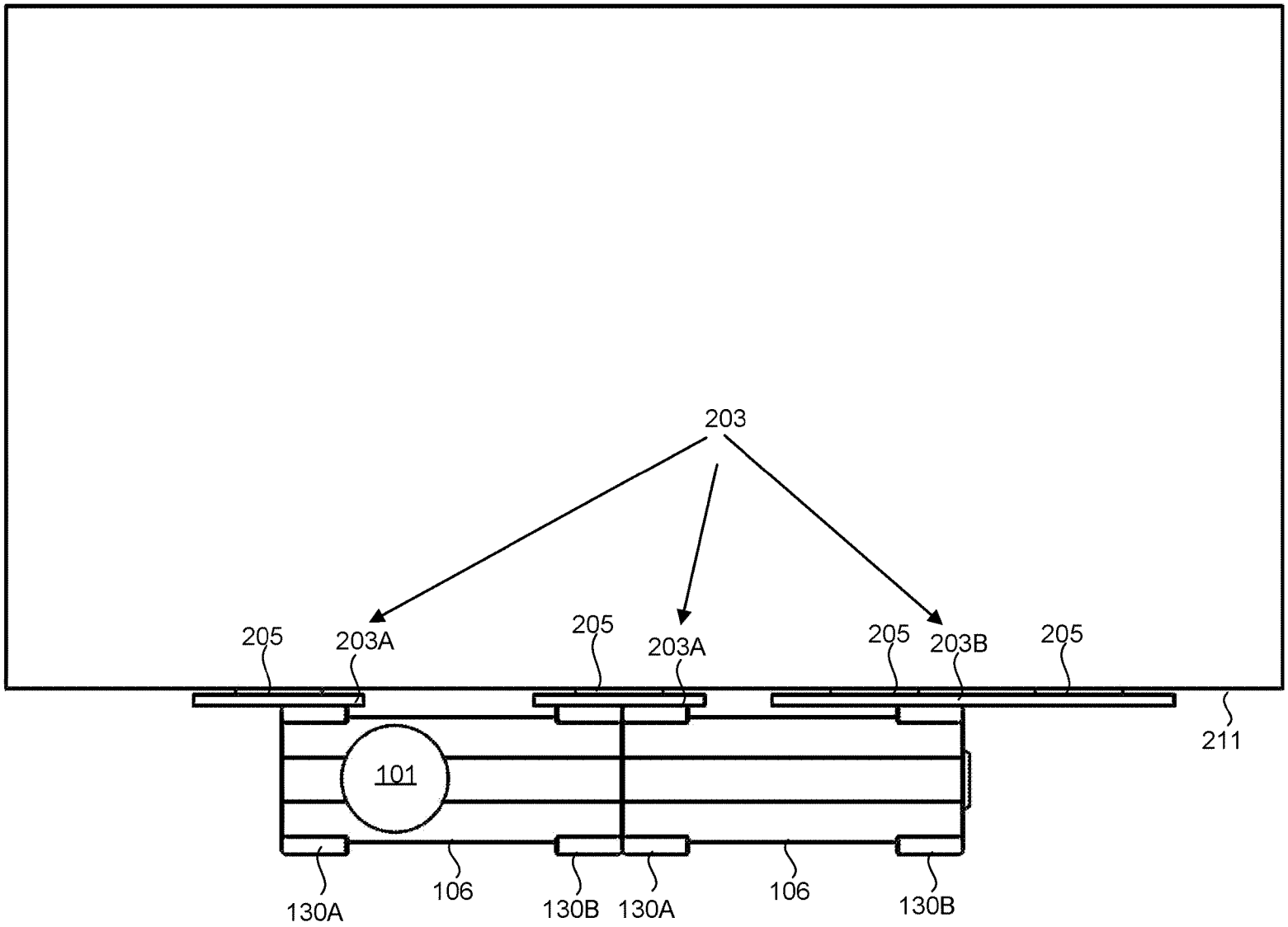
FIG. 2B is a top view of the assembly of FIG. 2A according to an embodiment.

FIG. 2A is a perspective view of an assembly 200 of track segments using magnetic connectors attached to ferromagnetic metallic plates of the track kit 100 according to an embodiment. FIG. 2B is a top view of the assembly of FIG. 2A according to an embodiment. In the illustrated embodiment, the assembly 200 includes several straight segments 106 of track along with corresponding pairs of the first connector 130A and the second connector 130B.

In various embodiments, the magnetic connectors are releasably attached to a vertical surface 211 that is not ferromagnetic. The track kit 100 may, therefore, include ferromagnetic plates 203 to be attached to the vertical surface first, e.g., through use of an adhesive 205 such as wall putty, strong double-backed tape, or the like, before attaching the track segments 106. The ferromagnetic plates 203 can be a circular ferromagnetic plate 203A or an elongated ferromagnetic plate 203B, such as a rectangular or oblong ferromagnetic plate. These ferromagnetic plates 203 can be made out of the same or similar metal discussed with reference to the flat ferromagnetic metal sheet 102. As discussed, the ferromagnetic plates 203 can be included within the track kit 100, e.g., in lieu of or in additional to the flat ferromagnetic metal sheet 102. In this way, the track kit 100 can be flexibly employed using the flat ferromagnetic metal sheet 102, which is expandable in a customized fashion using the ferromagnetic plates 203 for building the track on top of non-metal vertical surfaces.

Figures 3A, 3B, 3C:
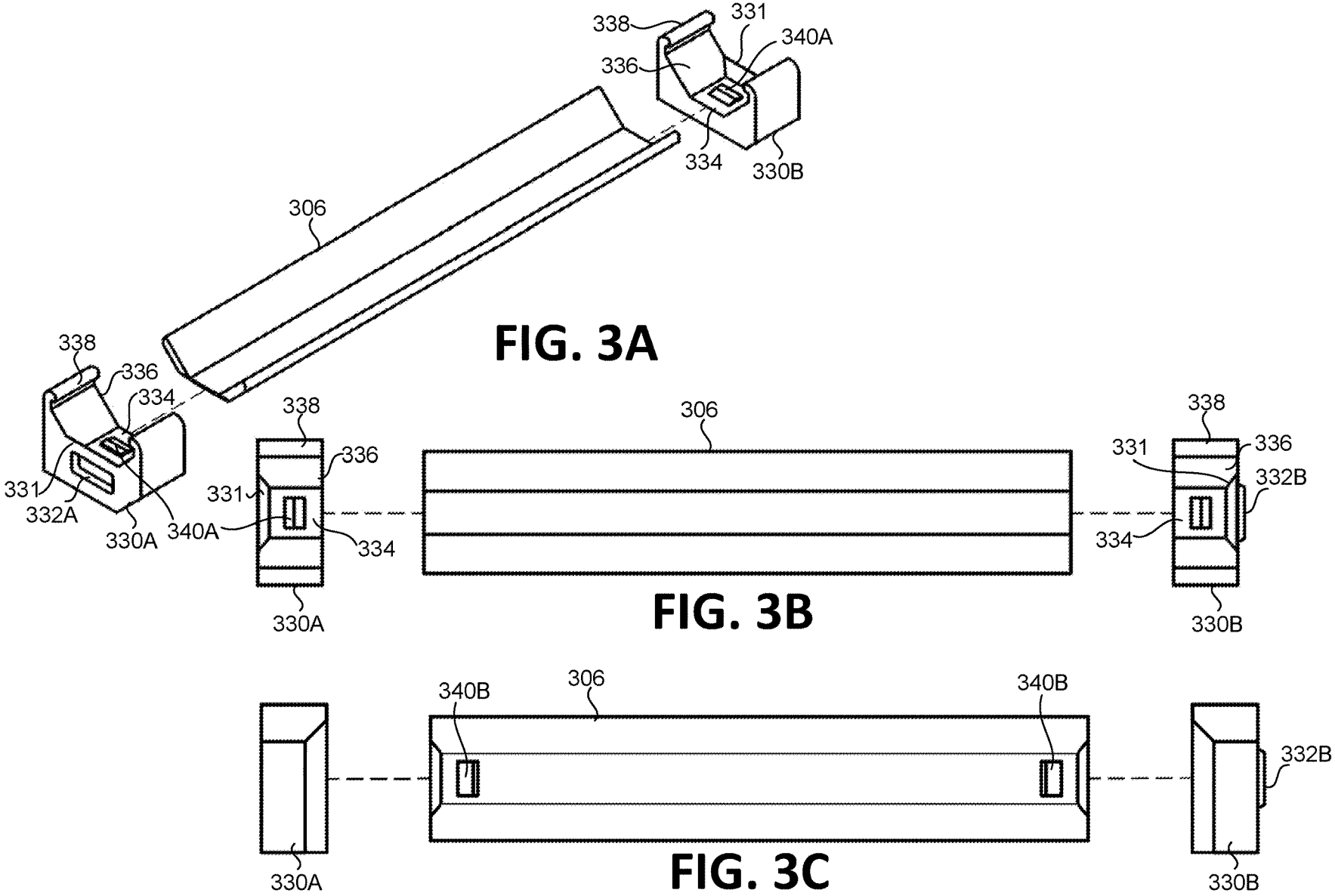
FIGS. 3A, 3B, 3C are perspective, top, and bottom exploded views, respectively, of a track segment and magnetic connector combination according to various embodiments.

FIGS. 3A, 3B, 3C are perspective, top, and bottom exploded views, respectively, of a track segment 306 and magnetic connector combination according to various embodiments. The track segment 306 is one of the straight segments 106, but in alternative embodiments, is one of the other track segments discussed with reference to FIG. 1. Each of the track segments illustrated in FIG. 1 and throughout this application can vary in profile of the track segment. More specifically, each track segment defines a channel through which the ball 101 (or other rolling object) passes down the track. The channel may have a profile that is U-shaped, V-shaped, semicircular, and/or that has 3, 4, 5, or 10 edges of the like.

In various embodiments, the magnetic connectors include a first connector 330A and a second connector 330B, where the first connector 330A is coupled to a trailing end of the track segment 306 and the second connector 330B is coupled to a leading end of the track segment 306. The connectors are sized to be much shorter than (e.g., typically no more than twenty percent (20%) although some may be as much as forty percent (40%) for shorter track pieces) the length of the track segments, thus enabling the use of a reduced track profile and thus the material needed to manufacture the track kit. Using less material means reducing the cost to manufacture the track kit 100.

In various embodiments, the first connector 330A and the second connector 330B each includes a front surface 331, a backside of which can be tapered in order to oppose and provide force on an end of the track segment 306. Within an interior of each of the first connector 330A and the second connector 330B further includes a locking surface 334 and two slanted sidewalls 336, each extending from the locking surface 334 to a protruding edge 338. The protruding edge 338 can be biased against a top edge of the track segment 306 when connecting the two track components. For example, each of the two slanted sidewalls 336 may include a protrusion (e.g., protruding edge 338) extending to the interior thereof, each protrusion to grip a top of a side of the track segment 306.

In some embodiments, the first connector 330A and the second connector 330B each include a lock protrusion 340A that extends above the locking surface 334. A bottom surface of the track segment 306 can include a lock depression 340B that is sized to receive the lock protrusion 340A while the end of the track segment 306 is biased against the backside of the front surface 331. In this way, each magnetic connector can be permanently attached in a locked state to the end of the track segment 306 by sliding the magnetic connector onto the end of the track segment 306, e.g., from a direction along a longitudinal axis formed by a length of the track segment 306, thus avoiding the use of adhesives, as was discussed previously. Thus, each magnetic connector is slidable onto at least one end of each track segment as generally discussed herein. Although permanently attached, the magnetic connectors can still be removed from the end of the track segment, if desired and with sufficient force, such as to re-attach the magnetic connectors to different track segments. A child would not typically have the force required to separate the magnetic connectors from the track segments (e.g., five or more pounds), thus not creating a choking hazard.

In disclosed embodiments, the first connector 330A further includes a female registry feature 332A and the second connector 330B further includes a male registry feature 332B, each defined within a respective front surface 331. The female registry feature 332A of one of the first connectors 330A is adapted to receive the male registry feature 332B of one of the second connectors 330B, to help attach the two together in building track segments into a larger track and supporting additional shear force while staying attached. The support of additional shear force enables greater resistance to movement when subjected to higher dynamic loading, e.g., fast moving ball or dropping ball onto a track segment. Also, as will be discussed, a magnet can be positioned within the magnetic connectors behind the front surface 331 to also provide an attractive magnetic force in addition to the shear force. These two forces provide a strength at a low cost that will keep the track assembled despite significant dynamic loads, e.g., staying assembled while supporting a $5/8^{ths}$ inch marble dropping from one to six inches above the track.

Figure 4C:
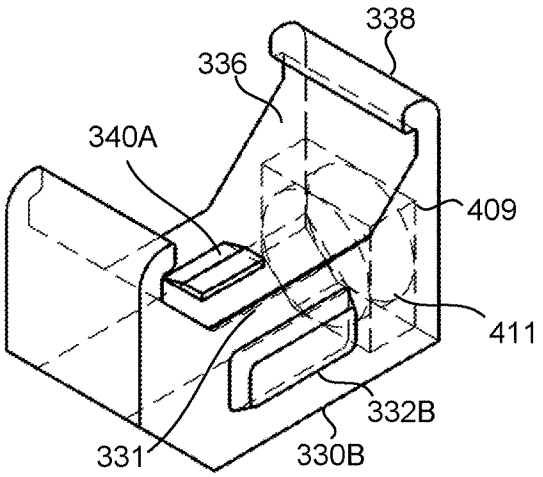
FIG. 4C is a perspective see-through view of a magnetic connector for a leading end of a track segment according to an embodiment.
Figure 4D:
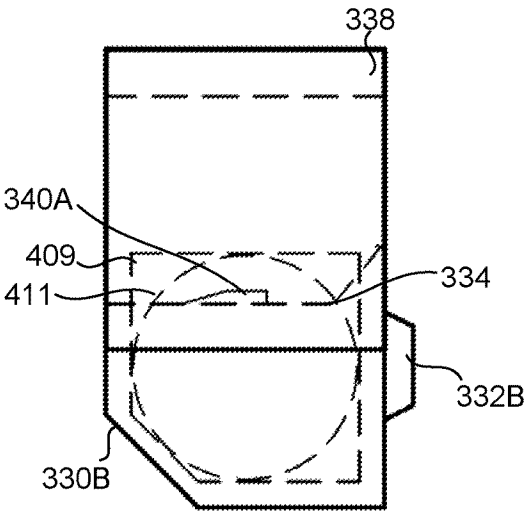
FIG. 4D is a side, see-through view of the magnetic connector of FIG. 4C according to an embodiment.
Figure 4A:
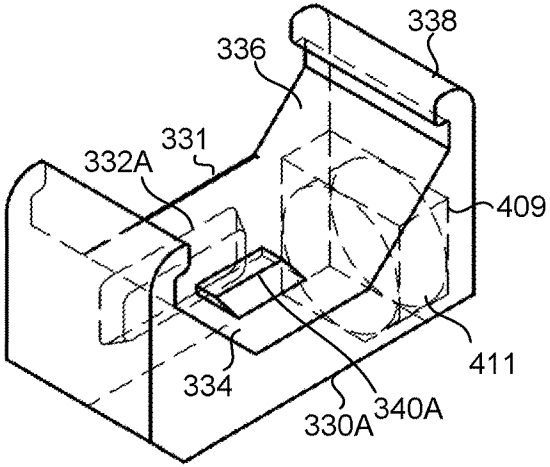
FIG. 4A is a perspective, see-through view of a magnetic connector for a trailing end of a track segment according to an embodiment.
Figure 4B:
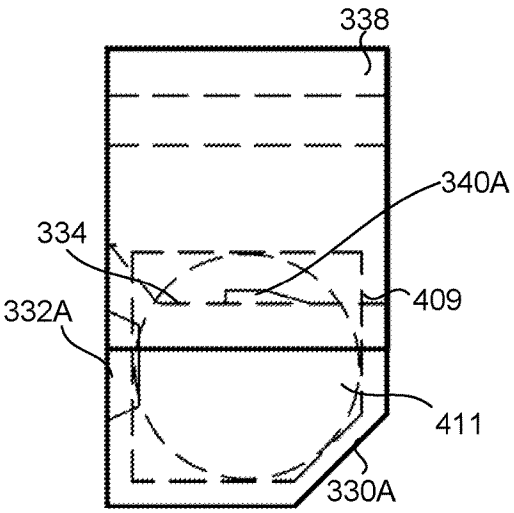
FIG. 4B is a side, see-through view of the magnetic connector of FIG. 4A according to an embodiment.

FIG. 4A is a perspective, see-through view of a magnetic connector for a trailing end of a track segment according to an embodiment. FIG. 4B is a side, see-through view of the magnetic connector of FIG. 4A according to an embodiment. FIG. 4C is a perspective see-through view of a magnetic connector for a leading end of a track segment according to an embodiment. FIG. 4D is a side, see-through view of the magnetic connector of FIG. 4C according to an embodiment.

The magnetic connector in FIGS. 4A-4B, for example, is the first connector 330A and the magnetic connector in FIGS. 4C-4D is the second connector 330B, which were discussed with reference to FIGS. 3A-3C. As an additional feature to these magnetic connectors, when each magnetic connector is 3D printed, a rectangular space 409 is defined within the side of the magnetic connector that is to be attached to the vertical surface (e.g., wall). There is still 3D-printed material between the rectangular space 409 and the side of the magnetic connector.

In some embodiments, while the 3D printing is paused, a magnet 411 is disposed within the rectangular space 409, and then the 3D printing finished, thus burying the magnet 411 invisibly inside of each of the magnetic connectors. In some embodiments, the magnet 411 is a high-strength neodymium magnet. Because the magnet 411 is buried within the magnetic connectors, the magnet 411 cannot fall out and create a choking (or other health) hazard. Further, assembly time of gluing or using adhesives to affix the magnets is avoided, and the lack of adhesives enables the track components to remain clean and maintain a clean appearance without glue drops or other visual flaws.

Figure 5:
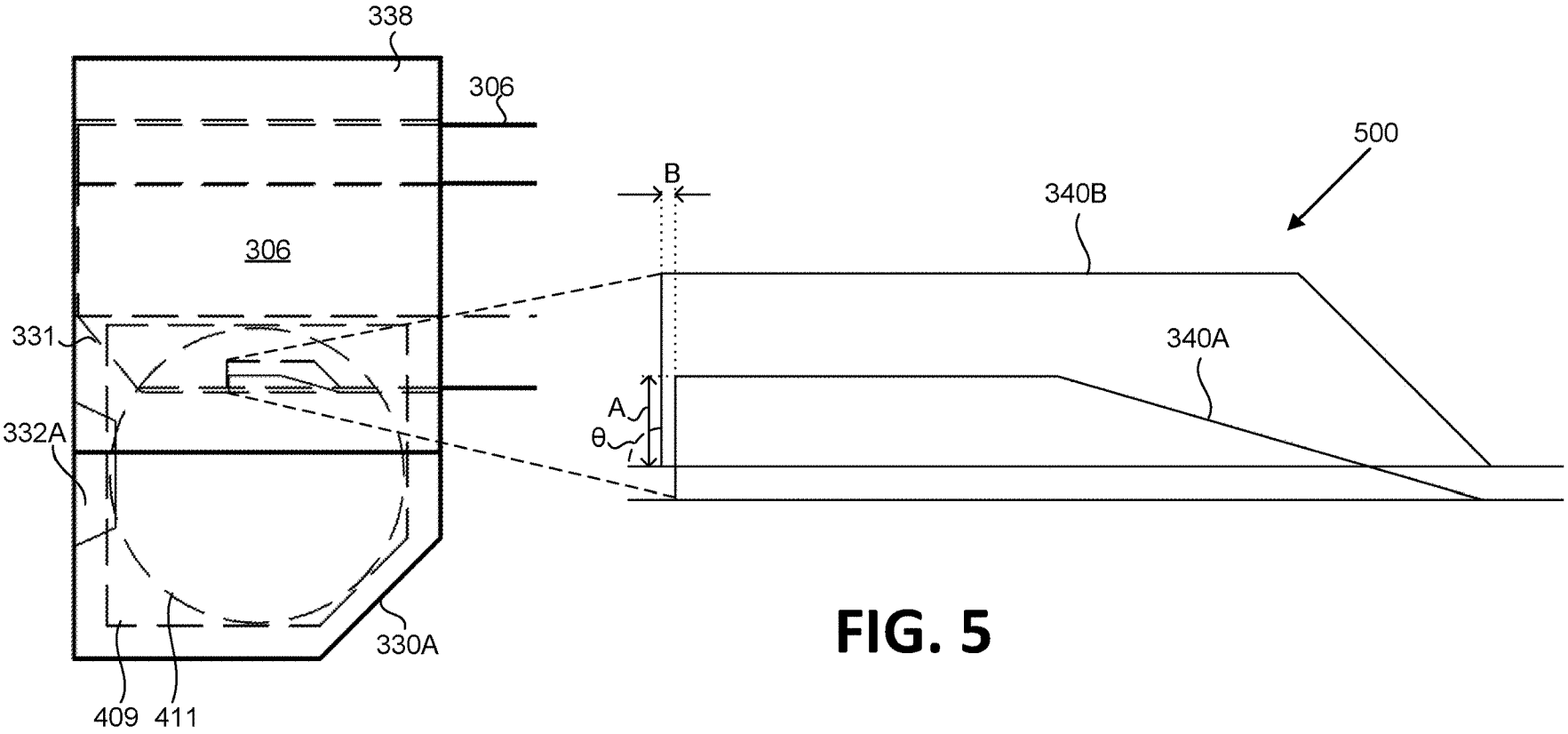
FIG. 5 is an enlarged side view of a lock mechanism between a track segment and the magnetic connector of FIGS. 4A-4B.

FIG. 5 is an enlarged side view of a lock mechanism 500 between a track segment and the magnetic connector of FIGS. 4A-4B, e.g., the first connector 330A. As illustrated in the exploded view of the lock mechanism 500, the lock protrusion 340A fits inside of the lock depression 340B and is held there with the biasing force of the track segment 306 against the backside of the front surface 331 of the first connector 330A. Although not illustrated, the lock mechanism 500 also exists between the track segment 306 and the second connector 330B, as illustrated with reference to FIGS. 3A-3C.

In this way, the each magnetic connector can be permanently attached in a locked state to the end of the track segment 306, thus avoiding the use of adhesives, as was discussed previously. Although permanently attached, the magnetic connectors can still be removed from the end of the track segment, if desired and with sufficient force, e.g., 0.25 to 10 pounds, such as to re-attach the magnetic connectors to different track segments.

With further reference to FIG. 5, the distance A defines a connector-track overlap that can range approximately between +0.001 and +0.020 inches. The distance B defines a connector-track offset, e.g., between a back wall of the lock depression 340B and the back wall of the lock protrusion 340A, when in locking position. In various embodiments, the distance B can range approximately between −0.010 and +0.010 inches. The range of distance B includes a negative endpoint due to accuracy in variations during manufacturing, to ensure a locking fit between the lock protrusion 340A and the lock depression 340B. The angle θ defines an angle between the back wall of the lock depression 340B and a top of a locking surface of the track segment 306. The angle θ can generally range between 45 and 90 degrees, although other values outside of this range may also be acceptable. These ranges for distance A, distance B, an angle θ may be scaled up or down for different-sized tracks, and are thus merely exemplary of the currently-sized design.

Figure 6A:
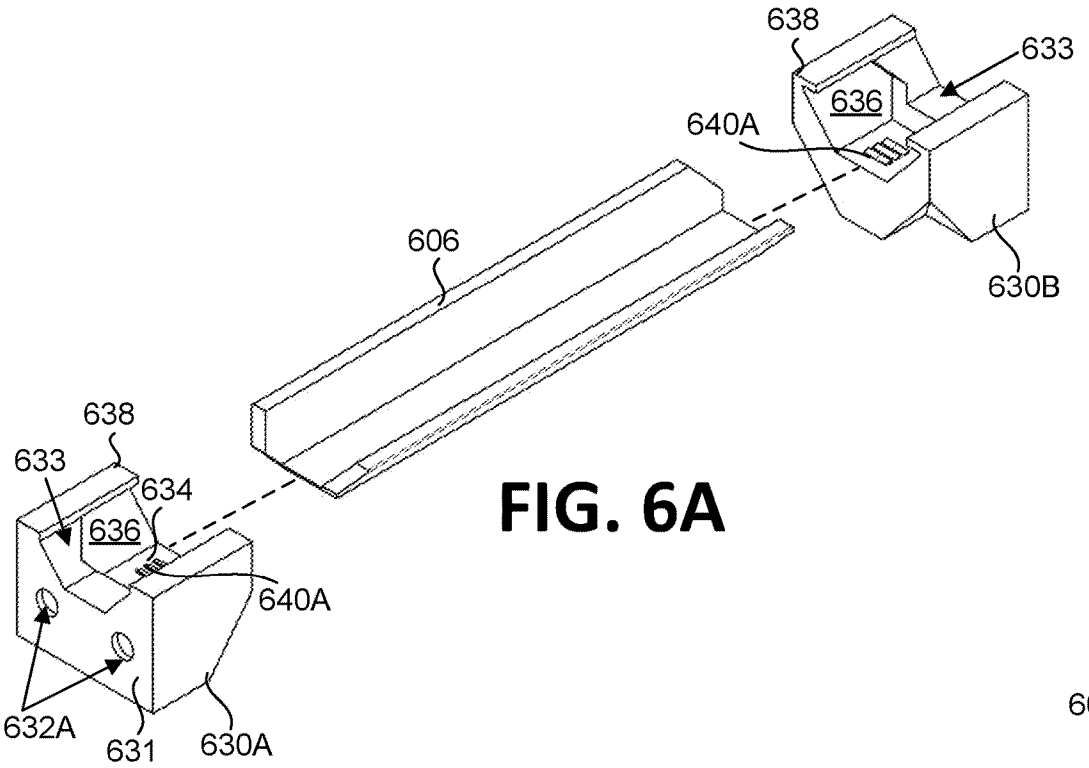
FIGS. 6A and 6B are top and bottom exploded views, respectively, of a track segment and coupled magnetic connectors according to another embodiment.
Figure 6B:
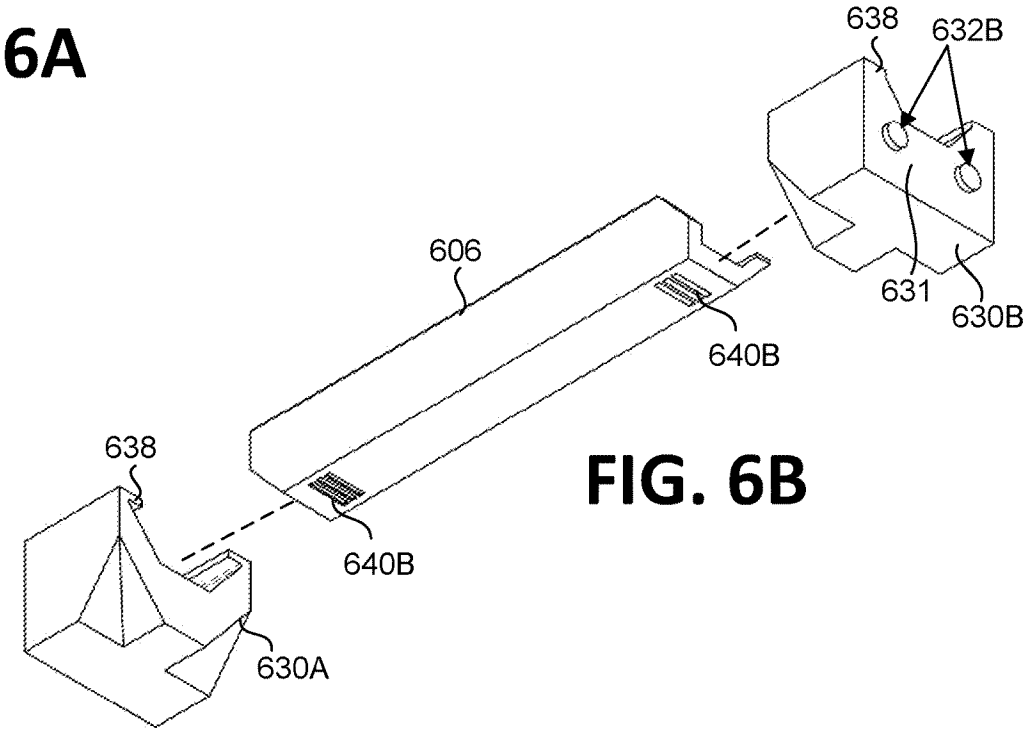

FIGS. 6A and 6B are top and bottom exploded views, respectively, of a track segment 606 and coupled magnetic connectors according to another embodiment. The coupled magnetic connectors can include a third connector 630A and a fourth connector 630B, where the third connector 630A is coupled to a trailing end of the track segment 606 and the fourth connector 630B is coupled to a leading end of the track segment 606. The magnetic connectors are sized to be much shorter than (e.g., typically no more than twenty percent (20%) although some may be as much as forty percent (40%) for shorter track pieces) the length of the track segments, thus enabling the use of a reduced track profile and thus the material needed to manufacture the the track kit.

In various embodiments, the third connector 630A and the fourth connector 630B each includes a front surface 631 of a back wall thereof. The back wall can define notched area 633 that removes material and corresponds to a height of the track segment so that the ball 101 can roll unimpeded through the magnetic connectors. Within an interior of each of the third connector 630A and the fourth connector 630B further includes a locking surface 634 and two slanted sidewalls 636, each extending from the locking surface 634 to a protruding edge 638. In one embodiment, the protruding edge 638 is biased against a top edge of the track segment 606 when connecting the two track components.

In some embodiments, the third connector 630A and the fourth connector 630B each include a group of ridges 640A that extends above the locking surface 634. A bottom surface of the track segment 606 can include a group of channels 640B that are sized to receive the group of ridges 640A while the end of the track segment 606 is biased against the back wall. In this way, each magnetic connector can be permanently attached in a locked state to the end of the track segment 606, thus avoiding the use of adhesives, as was discussed previously. Although permanently attached, the magnetic connectors can still be removed from the end of the track segment, if desired and with sufficient force, such as to re-attach the magnetic connectors to different track segments.

In disclosed embodiments, the third connector 630A further includes one or more female registry feature 632A and the fourth connector 630B further includes one or more male registry feature 632B, each defined within a respective front surface 631. Each female registry feature 632A of one of the third connectors 630A is adapted to receive a male registry feature 632B of one of the fourth connectors 630B, to help attach the two together in building track segments into a larger track and supporting additional shear force while staying attached. The support of additional shear force enables greater resistance to movement when subjected to higher dynamic loading, e.g., fast moving ball or dropping the ball onto a track segment. Also, as will be discussed, a magnet can be positioned within the magnetic connectors behind the front surface 631 to also provide an attractive magnetic force in addition to the shear force. These two forces provide a strength at a low cost that will keep the track assembled despite significant dynamic loads, e.g., staying assembled while supporting a $\frac{5}{8}^{ths}$ inch marble dropping from one to six inches above the track.

FIGS. 7A, 7B, 7C are a perspective view and top and front see-through views, respectively, of a magnetic connector having two side magnets and to couple to a trailing end of a track segment according an embodiment. For example, the magnetic connector can be a fifth connector 730A that, like the first connector 330A, includes a front face 731, a locking surface 734 having a lock protrusion 740A, and two sidewalls 736 that each extend from the locking surface 734 to a protruding edge 738. The fifth connector 730A can further include a female registry feature 732A.

In various embodiments, a second outer sidewall of the fifth connector 730A can include a male registry feature 750A and a first outer sidewall of the fifth connector 730A can include a female registry feature 750B. The female registry feature 750B of one of the fifth connectors 730A can receive the male registry feature 750A of another one of the fifth connectors 730A when in a side-by-side configuration.

In some embodiments, the fifth connector 730A includes a first magnet 711A embedded in the first outer sidewall and a second magnet 711B embedded in the second outer sidewall of the fifth connector 730A. These magnets can be inserted during 3D printing, injection molding, or other type of manufacturing process. The top see-through view of FIG. 7B illustrates a horizontal positioning of the magnets according to an embodiment and the front see-through view of FIG. 7C illustrates vertical and horizontal positioning of the magnets. In embodiments, the first magnet 711A is polarized in the same direction as second magnet 711B within each connector so that the two magnets attract to enable side-by-side attachment of two of the fifth connectors 730A. However, the first magnet 711A and the second magnet 711B within the fifth connector 730A are polarized opposite to the first magnet 711A and the second magnet 711B within the sixth connector 730B. When attached in this way, the male registry feature 750A fits inside of the female registry feature 750B to again, as explained previously, provide support from lateral stresses and dynamic loads.

FIGS. 7D, 7E, 7F are a perspective view and top and front see-through views, respectively, of a magnetic connector having two side magnets and to couple to a leading end of a track segment according an embodiment. For example, the magnetic connector can be a sixth connector 730B that, like the second connector 330B, includes the front face 731, the locking surface 734 having the lock protrusion 740A, and two sidewalls 736 that each extend from the locking surface 734 to the protruding edge 738. The sixth connector 730B can further include a male registry feature 732B adapted to fit inside of the female registry feature 732A to provide support against shear stresses and dynamic loads when one of the sixth connectors 730B is attached to one of the fifth connectors 730A (see FIG. 1).

In various embodiments, a second outer sidewall of the sixth connector 730A can include the male registry feature 750A and a first outer sidewall of the sixth connector 730A can include a female registry feature 750B. The female registry feature 750B of one of the sixth connectors 730B can receive the male registry feature 750A of another one of the sixth connectors 730B when in a side-by-side configuration.

In some embodiments, the sixth connector 730B includes the first magnet 711A embedded in the first outer sidewall and the second magnet 711B embedded in the second outer sidewall of the fifth connector 730B. These magnets can be inserted during 3D printing, injection molding, or other type of manufacturing process. The top see-through view of FIG. 7D illustrates a horizontal positioning of the magnets according to an embodiment and the front see-through view of FIG. 7C illustrates vertical and horizontal positioning of the magnets. In embodiments, the first magnet 711A is polarized in the same direction as the second magnet 711B so that the two magnets attract to enable side-by-side attachment of two of the sixth connectors 730B. When attached in this way, the male registry feature 750A fits inside of the female registry feature 750B to again, as explained previously, provide support from lateral stresses and dynamic loads.

Figure 8:
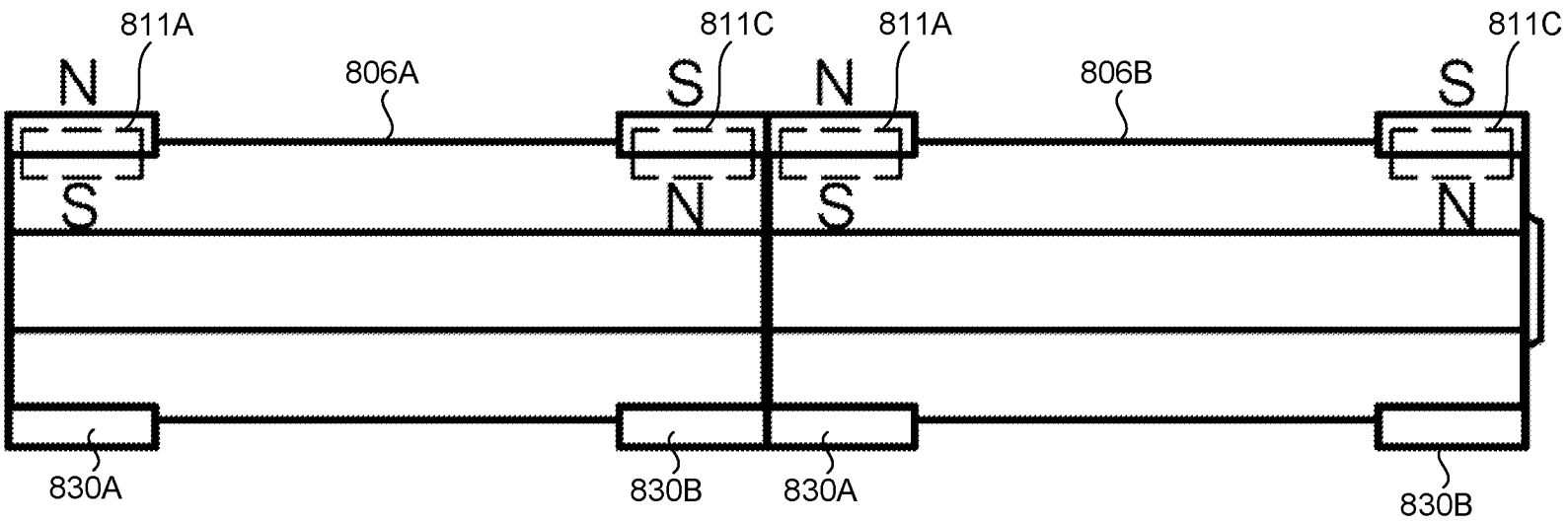
FIG. 8 is a top view of two track segments that are interconnected using polar opposite magnets in coupled magnetic connectors according to an embodiment.

FIG. 8 is a top view of two track segments, a first track segment 806A and a second tack segment 806B, which are interconnected using polar opposite magnets in coupled magnetic connectors according to an embodiment. In various embodiments, each of the first track segment 806A and the second track segment 806B includes a first connector 830A attached to a trailing end of the track segment and a second connector 830 attached to a leading end of the track segment. The second connector 830B of the first track segment 806A thus attaches to the first connector 830A of the second track segment.

In various embodiments, the first connector 830A includes a first magnet 811A and the second connector 830B includes a second magnet 811C, each of which is oppositely polarized along the corresponding outer sidewalls. Thus, the first magnet 811A that is embedded in the first connector 830A has an opposite polarity to the second magnet 811C that is embedded in the second connector 830B, such that the second connector 830B is attracted to another first connector, which is attached to a second track segment. Although the first magnet 811A is illustrated as having a north/south polarization and the second magnet 811C as having a south/north polarization with respect to a vertical surface (e.g., wall), these can be switched and still be oppositely polarized. Due to the opposite polarization between the first magnet 811A and the second magnet 811C, the first connector 830A and the second connectors 830B are mutually attracted, thus helping, along with male and female registry features discussed herein, to keep the two magnetic connectors attached. As will be discussed with reference to FIGS. 9A-9B, the magnetic connectors can also have a magnet in (e.g., behind) a front surface that interfaces with another connector, which are also oppositely polarized that can provide still further attractive force between the first and second connectors 830A and 830B.

Figures 9A, 9B, 9C, 9D:
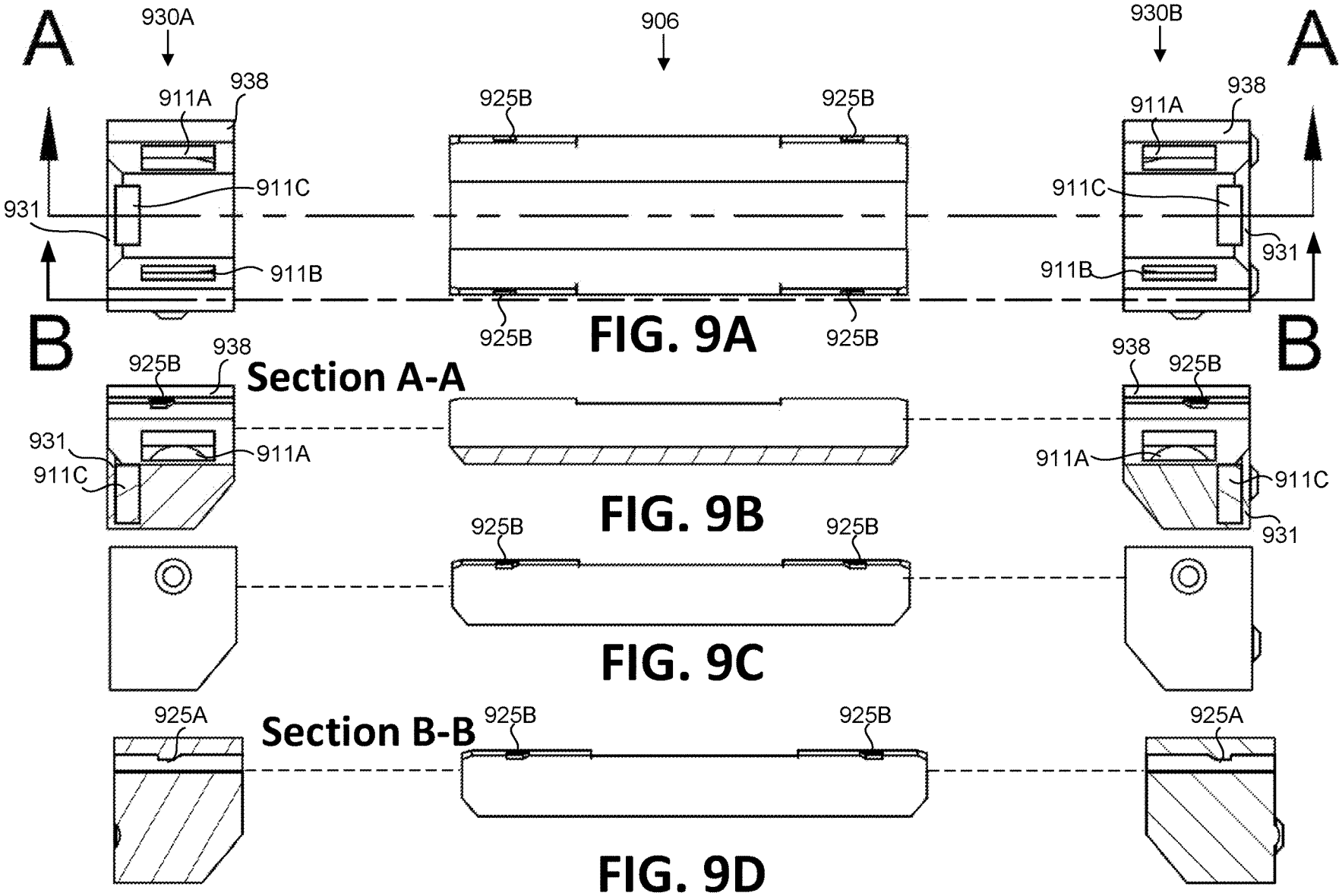
FIG. 9A is a top, exploded view of a track segment and pair of magnetic connectors having three magnets according to an embodiment.
FIG. 9B is a cross-section view of the track segment and pair of magnetic connectors along Section A-A illustrated in FIG. 9A according to an embodiment.
FIG. 9C is a side view of the track segment and pair of magnetic connectors of FIG. 9A according to an embodiment.
FIG. 9D is the cross-section view of the track segment and pair of magnetic connectors along Section B-B illustrated in FIG. 9A according to an embodiment.

FIG. 9A is a top, exploded view of a track segment 906 and pair of magnetic connectors having three magnets according to an embodiment. For example, the pair of magnetic connectors can include a seventh connector 930A and an eighth connector 930B. FIG. 9B is a cross-section view of the track segment 906 and the pair of magnetic connectors along Section A-A illustrated in FIG. 9A according to an embodiment. FIG. 9C is a side view of the track segment and pair of magnetic connectors of FIG. 9A according to an embodiment. FIG. 9D is the cross-section view of the track segment and pair of magnetic connectors along Section B-B illustrated in FIG. 9A according to an embodiment.

As the track components illustrated in FIGS. 9A-9D have similar features to those already discussed, particular mention is made of different or additional features. In some embodiments, each of the seventh connector 930A and the eighth connector 930B include three magnets that can be inserted after 3D printing or other manner of manufacturing. In one embodiment, a first magnet 911A is located within a first outer side, a second magnet 911B is located within a second outer side opposite from the first outer side, and a third magnet 911C is located within a front side 931 of each of the seventh and eighth connectors 930A and 930B. The positioning of the magnets is such that insertion of the track segment 906 results in holding the magnets in place in their desired position as shown. Accordingly, FIG. 9A labels the locations where the magnets are located as the first magnet 911A, the second magnet 911B, and the third magnet 911C, respectively. FIG. 9B, furthermore, illustrates both the first magnet 911A and the third magnet 911C as the view from cross-section A-A of FIG. 9A.

In various embodiments, the first magnet 911A in each of the seventh connector 930A and the eighth connector 930B is employed for attaching the two connectors to a ferromagnetic metallic surface such as the flat ferromagnetic metal sheet 102 or the ferromagnetic plates 203 (FIG. 2A). Furthermore, the second magnet 911B in each of the seventh connector 930A and the eighth connector 930B is optionally employed for side-by-side attachment to another one of each of the seventh connector 930A and the eighth connector 930B, respectively. Finally, the third magnet 911C in each of the seventh connector 930A and the eighth connector 930B can be employed to help attach one of the eighth connectors 930B to one of the seventh connectors 930A in attaching two track segments to each other. Adding the third magnet 911C behind a front surface 931 of each magnetic connector provides additional force of attraction between mating connectors that is in addition to the resistance to shear force provided by registry marks, which was already discussed.

With additional reference to FIGS. 9A-9D, each of the seventh connector 930A and the eighth connector 930B includes a cutout 925A area (best seen in FIG. 9D) just below a protruding edge 938 (e.g., an upper lip) on each side of the two magnetic connectors. The view of FIG. 9D illustrates just the cutouts 925A on one side by way of example, but are understood to exist on both sides. Further, the track segment 906 includes a tab 925B (e.g., a protrusion) extending from the upper edge of sides of respective ends of the track segment 906. These tabs 925B then correspond to and insert inside of the cutouts 925A of the magnetic connectors as an alternative lock design to secure the seventh connector 930A and the eighth connector 930B to the track segment 906. In another embodiment, each of the seventh connector 930A and the eighth connector 930B may include a tab (e.g., a protrusion) instead of a cutout, and the track segment 906 may include a cutout instead of a tab. In another embodiment, each of the seventh connector 930A and the eighth connector 930B may include a tab (e.g., a protrusion) on one side and a cutout on the other side that correspond to and insert inside of a respective cutout and tab on the sides of the track segment 906.

Figures 10A, 10B, 10C:
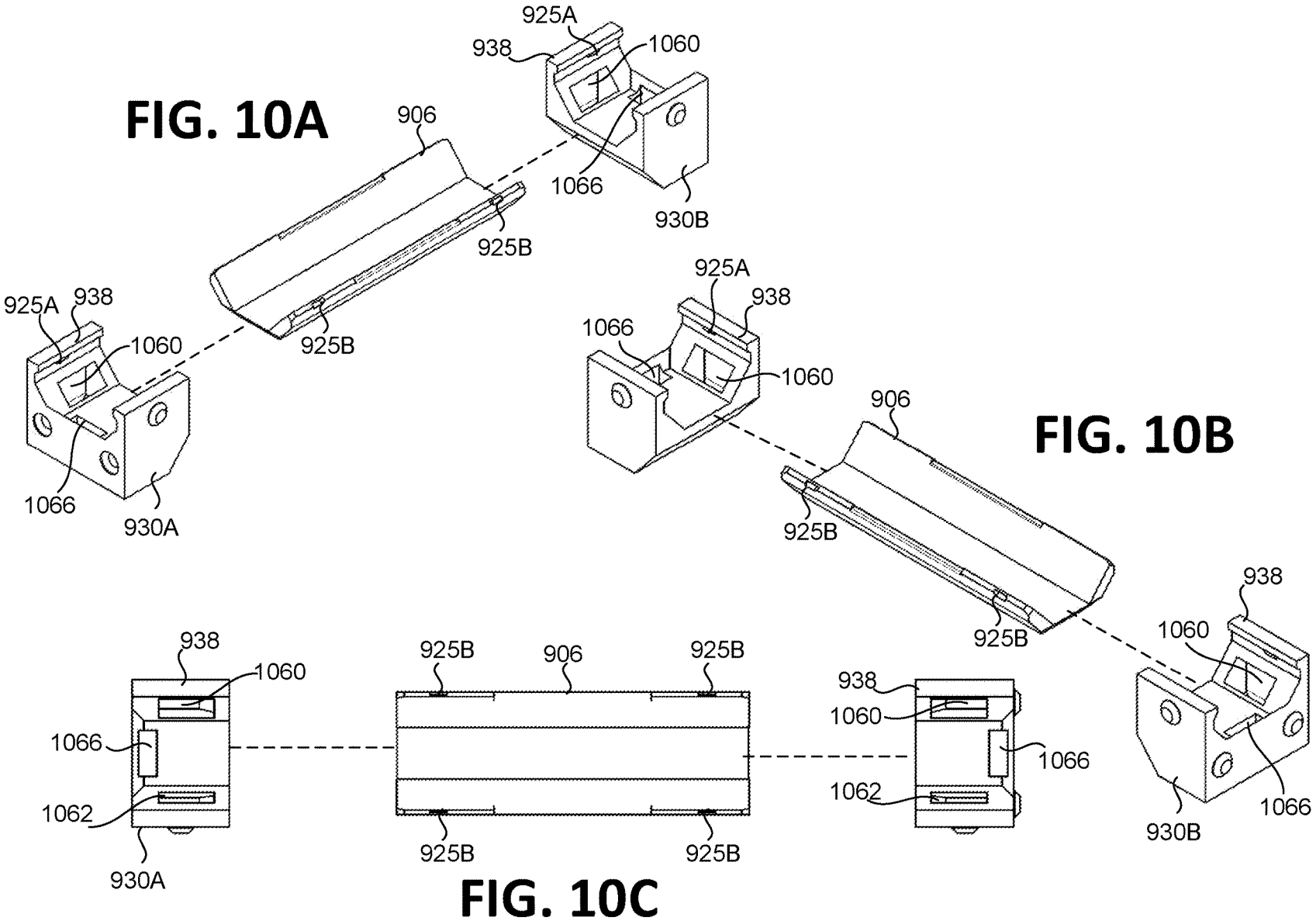
FIGS. 10A, 10B, 10C are rear perspective, front perspective, and top exploded views, respectively, of a pair of connectors coupled to a track segment according to an embodiment.
Figure 10D:
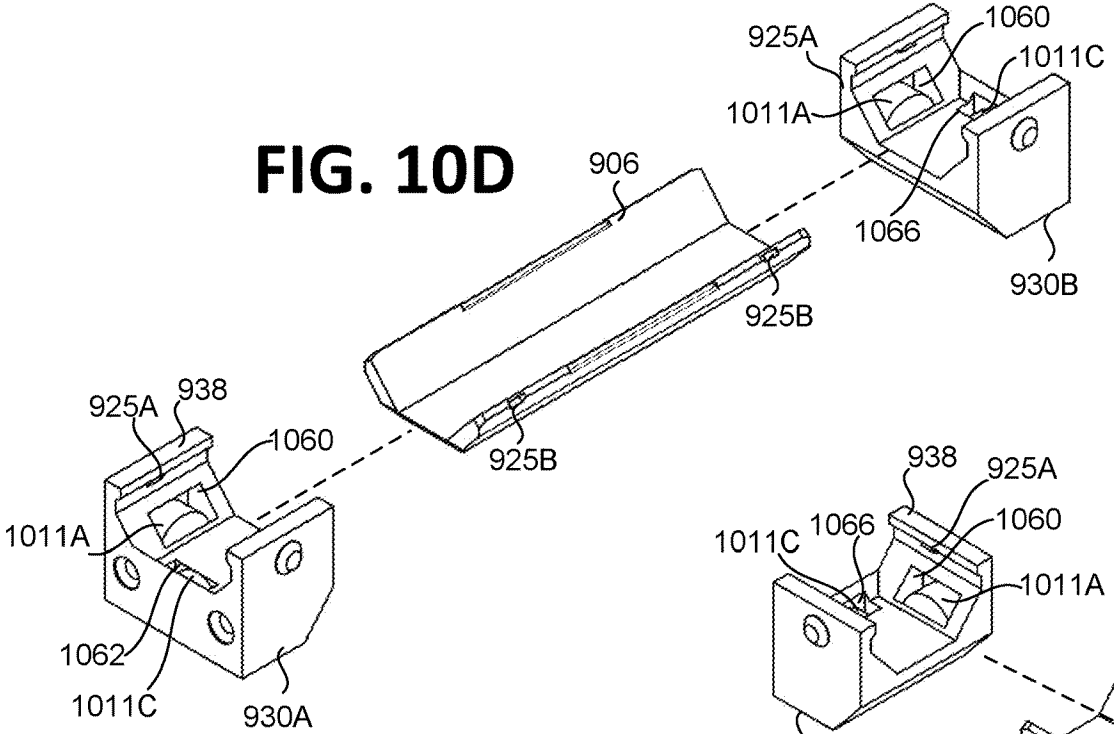
FIGS. 10D and 10E are the rear perspective and front perspective exploded views of FIGS. 10A and 10B, respectively, after insertion of side magnets according to an embodiment.
Figure 10E:
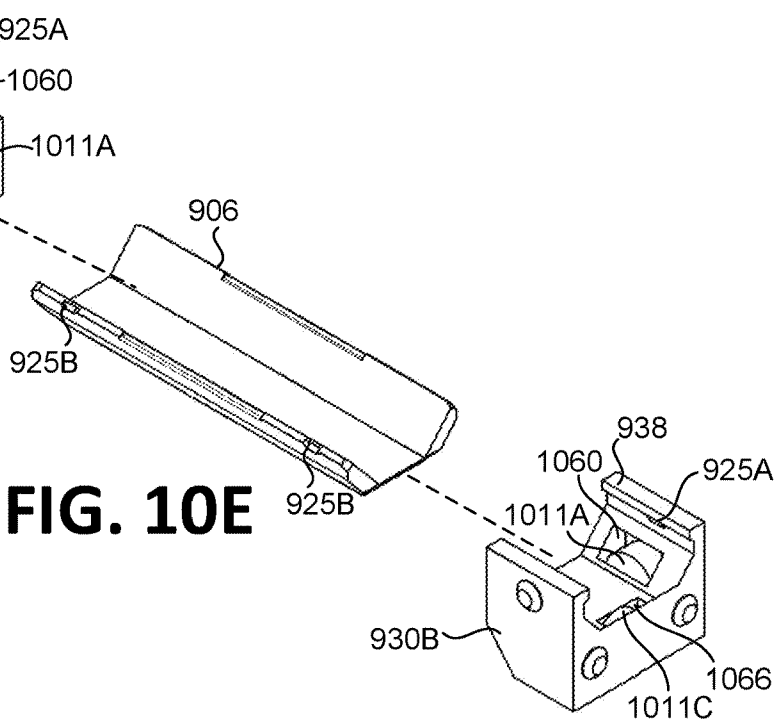

FIGS. 10A, 10B, 10C are rear perspective, front perspective, and top exploded views, respectively, of a pair of connectors coupled to a track segment according to an embodiment. FIGS. 10D and 10E are the rear perspective and front perspective exploded views of FIGS. 10A and 10B, respectively, after insertion of side magnets according to an embodiment. For simplicity of explanation, the embodiment of FIGS. 10A-10E are discussed as an extension of the embodiment of FIG. 9A-9D.

In various embodiments, each of the seventh connector 930A and the eighth connector 930B is 3D printed (or otherwise manufactured) to include a first opening 1060 in a first inner side wall (e.g., sidewall 736 of FIGS. 7A and 7D), a second opening 1062 in a second inner side wall opposite the first inner side wall, and a third opening 1066 in the front side 931. Instead of completing the 3D printing to cover these openings, the 3D printing can be completed in a continuous operation and define the first opening 1060, the second opening 1062, and the third opening 1066.

In corresponding embodiments, after 3D printing is complete, a first magnet 1011A is inserted in the first opening 1060, a second magnet (not illustrated but understood to be in the opposing sidewall from the first magnet) in the second opening 1062, and a third magnet 1011C is inserted in the front side 931 of each of the seventh connector 930A and the eighth connector 930B. Because the seventh connector 930A and the eighth connector 930B are oriented generally horizontally when attached to a track segment 906, these magnets do not fall out during assembly and are permanently affixed inside the connectors. In this way, the track kit 100 can be built with a certain number of insertable magnets that can be swapped in and out of the connectors depending which ones are being used.

This adaptation to the track kit 100 can enable the manufacturing of the track kit 100 less expensively as the magnets are one of the higher cost components. Furthermore, some of the ways of assembling the magnetic connectors and the track segments may obviate the need for the second magnet and/or the third magnet, and thus more of the included magnets can be used as the first magnet 1011A for attachment of the magnetic connectors to a ferromagnetic surface.

Figures 11A, 11B, 11C:
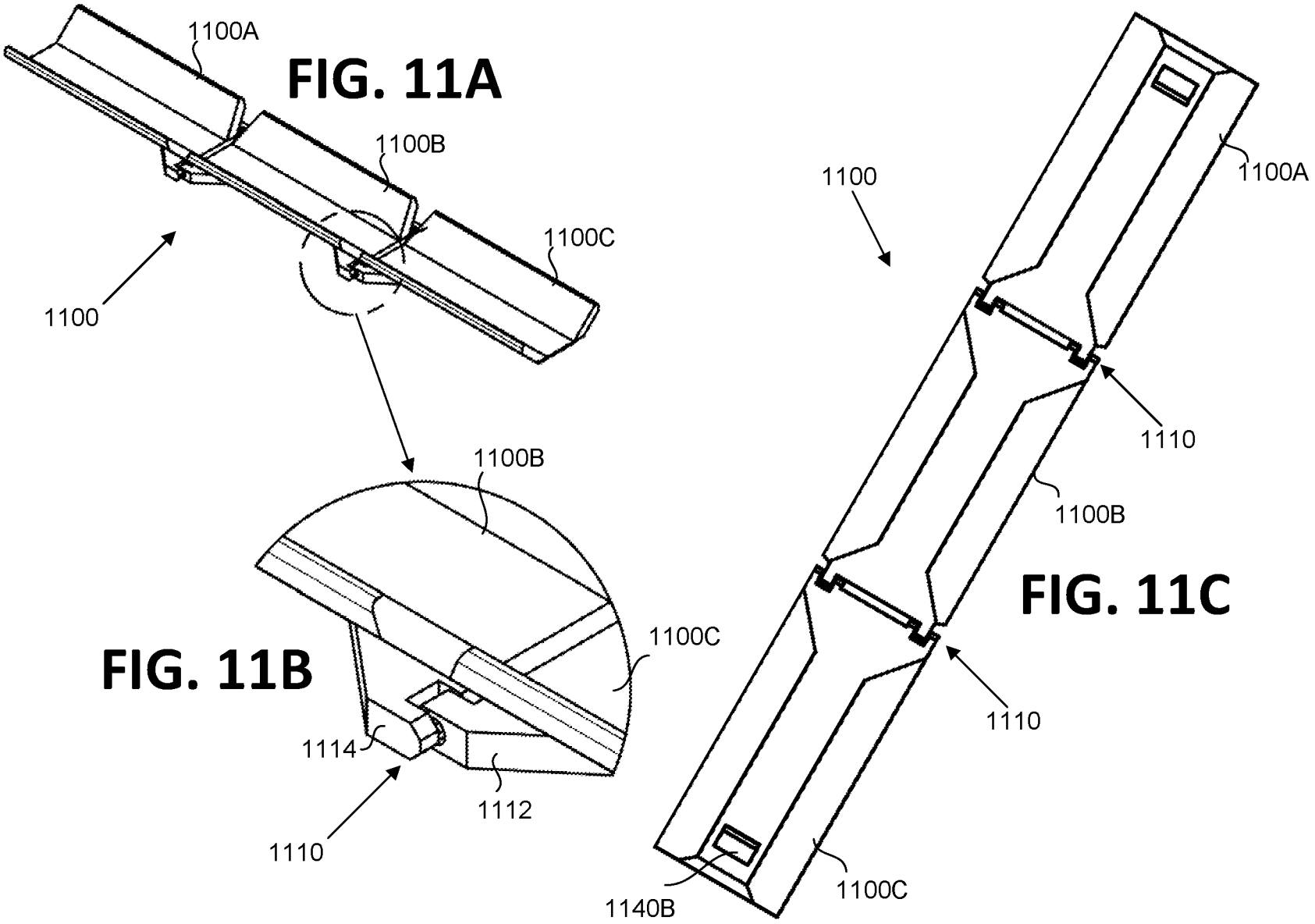
FIG. 11A is a perspective view of a snake track segment according to an embodiment.
FIG. 11B is an exploded view of a hinge between movable sections of the snake track segment according to an embodiment.
FIG. 11C is a top view of the snake track segment according to an embodiment.

FIG. 11A is a perspective view of a snake track segment 1100 according to an embodiment. FIG. 11B is an exploded view of a hinge 1110 between movable sections of the snake track segment 1100 according to an embodiment. FIG. 11C is a top view of the snake track segment 1100 according to an embodiment. The snake track segment 110 may be the same or similar as the snake segment 120 illustrated in FIG. 1.

In these embodiments, the snake track segment 1100 can include a number of sub-segments, such as a first sub-segment 1100A, a second sub-segment 1100B, and a third sub-segment 1100C, which are formed by 3D printing. The layers of the snake track segment 1100 can be laid down in such a way that simultaneously forms the hinge 1110 between each sub-segment. The hinge 1110 can include a male portion 1112 that rotatably attaches inside of a female portion 1114. Because the layers of the 3D printing that make up the hinge also extend, at least in part, through to form the sub-segments, the sub-segments of the snake track segment 1100 can move with respect to each other. A bottom side of the end portions of the outer sub-segments can form a lock depression 1140B, which may be similar to the lock depression 340B discussed with reference to FIGS. 3B-3C.

Figure 12B:
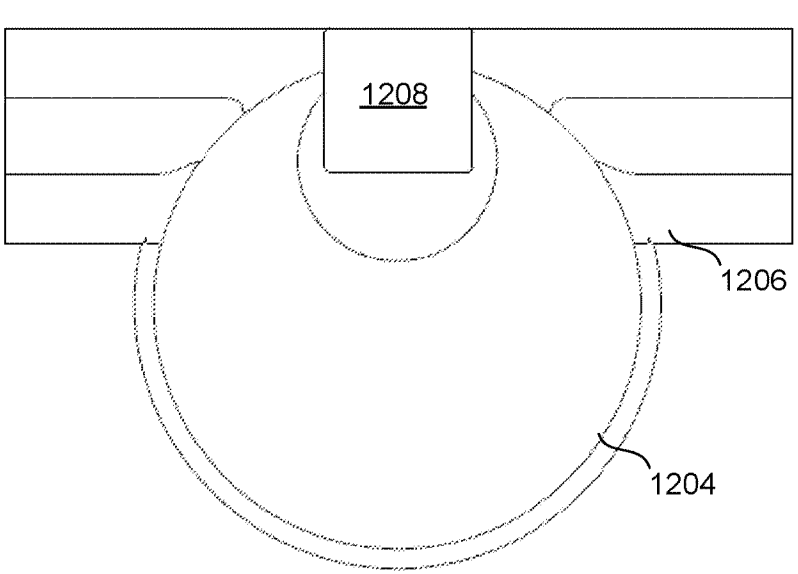
FIGS. 12A, 12B, 12C are a perspective, a top, and a bottom view, respectively, of a funnel track segment according to an embodiment.
Figure 12A:
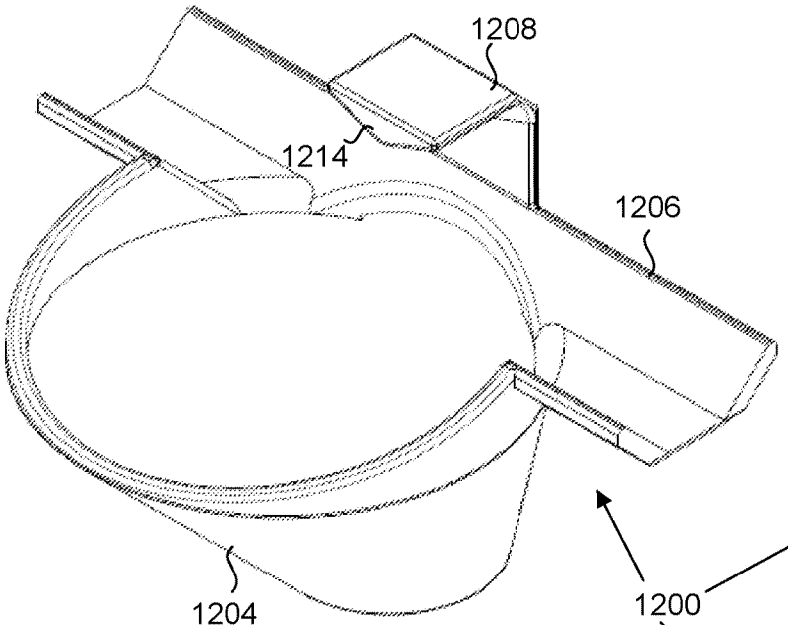
Figure 12C:
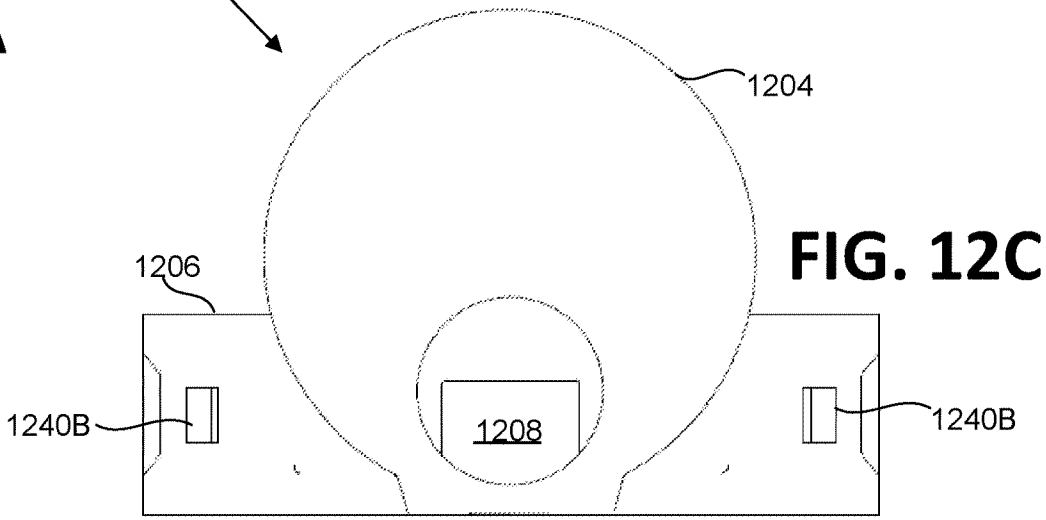

FIGS. 12A, 12B, 12C are a perspective, a top, and a bottom view, respectively, of a funnel track segment 1200 according to an embodiment. The funnel track segment 1200 may be the same or similar as the funnel segment 124 illustrated in FIG. 1. The funnel track segment 1200 may include a track segment 1206 (similar to the other track segments discussed herein), but from which is formed (e.g., 3D printed) a funnel 1204. The funnel 1204 may be generally cone-shaped with a larger circumference around and building from the track segment 1206 and dropping down to a smaller circumference at a bottom of the funnel 1204. In this way, a ball traveling either direction down the track segment 1206 falls through and out a bottom of the funnel 1204 onto another track segment or assembly.

The funnel track 1200 may further include an extended cantilever 1208 having a drop 1214 at an end thereof. The extended cantilever 1208 may be generally printed up off an opposite side of the track segment 1206 from the funnel 1204. The drop 1214 may protrude partially, from the extended cantilever 1208, down towards the funnel 1204. In this way, if a ball traveling down the track segment 1206 is bouncing or moving above a surface of the track segment 1206, the ball impinges against the drop 1214 and is forced into the upper circumference of the funnel 1204 to fall down through the funnel 1204. Further, a bottom side of the track segment 1206 may form a lock depression 1240B, which may be similar to the lock depression 340B discussed with reference to FIGS. 3B-3C.

Figures 13A, 13B:
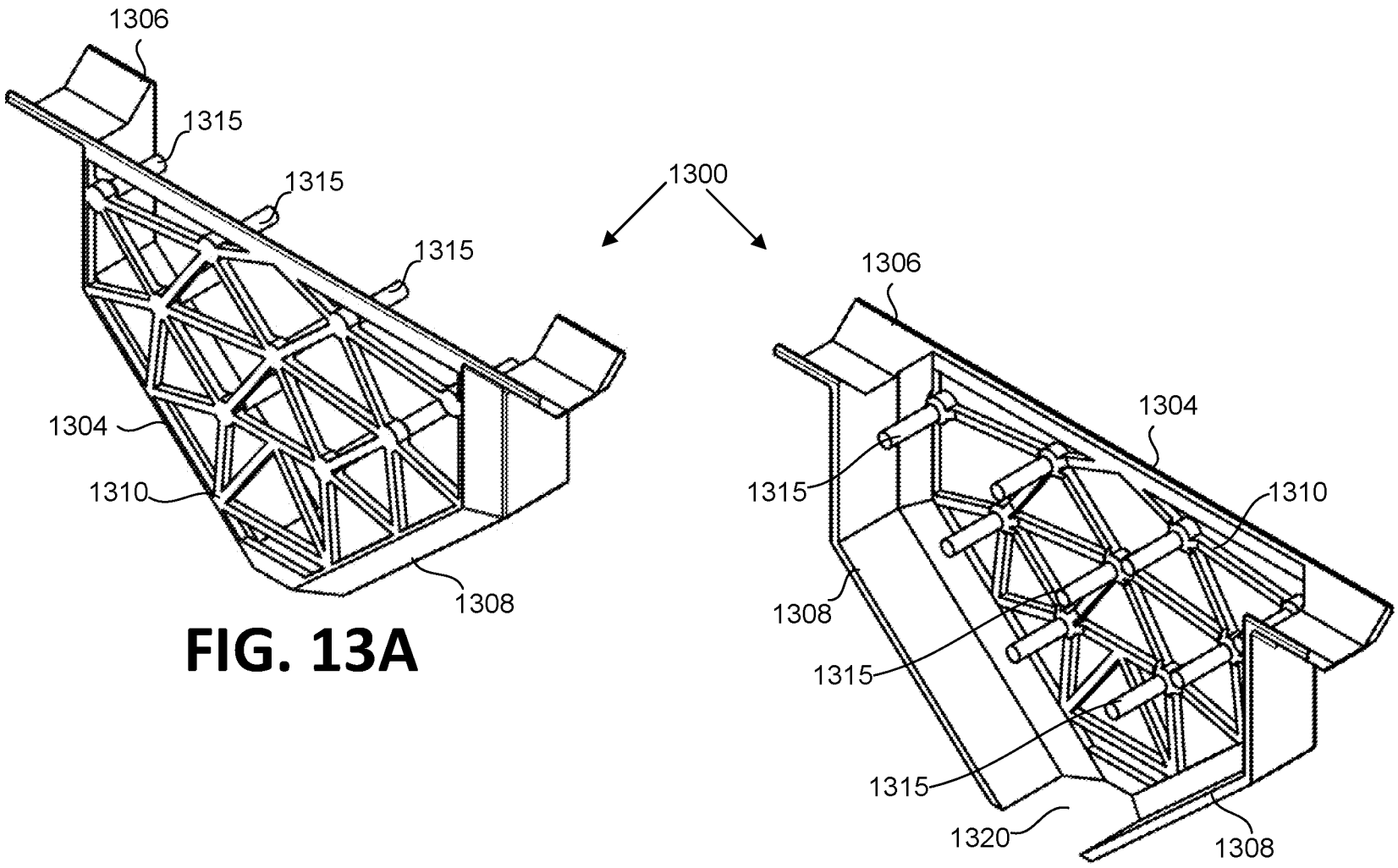
FIGS. 13A and 13B are back perspective and front perspective views, respectively, of a pegs track segment according to an embodiment.

FIGS. 13A and 13B are back perspective and front perspective views, respectively, of a pegs track segment 1300 according to an embodiment. The pegs track segment 1300 may include a track segment 1306 (similar to the other track segments discussed herein), but from which is formed a peg-board-like structure having sidewalls 1308, a lattice structure 1310 within the sidewalls 1308, and multiple pegs 1315 attached at intersections of the lattice structure 1310. In some embodiments, the multiple pegs 1315 are attached generally perpendicular to the lattice structure 1310. The sidewalls 1308 and lattice structure 1310 may converge into a bottom orifice 1320. In this way, a ball that is traveling either direction down the track segment 1306 is randomly directed between the multiple pegs 1315 and ultimately through the orifice 1320 at the bottom of the pegs track segment 1300. The ball may fall out of the orifice onto another track segment or assembly.

Figure 14B:
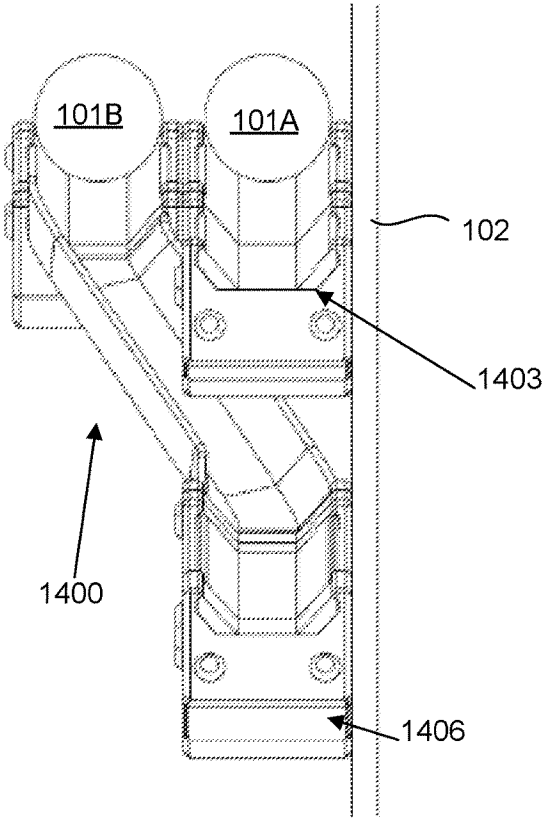
FIGS. 14A, 14B, 14C are perspective, side, and top views, respectively, of a side-by-side track assembly using magnets on two sides of magnetic connectors according to various embodiments.
Figure 14A:
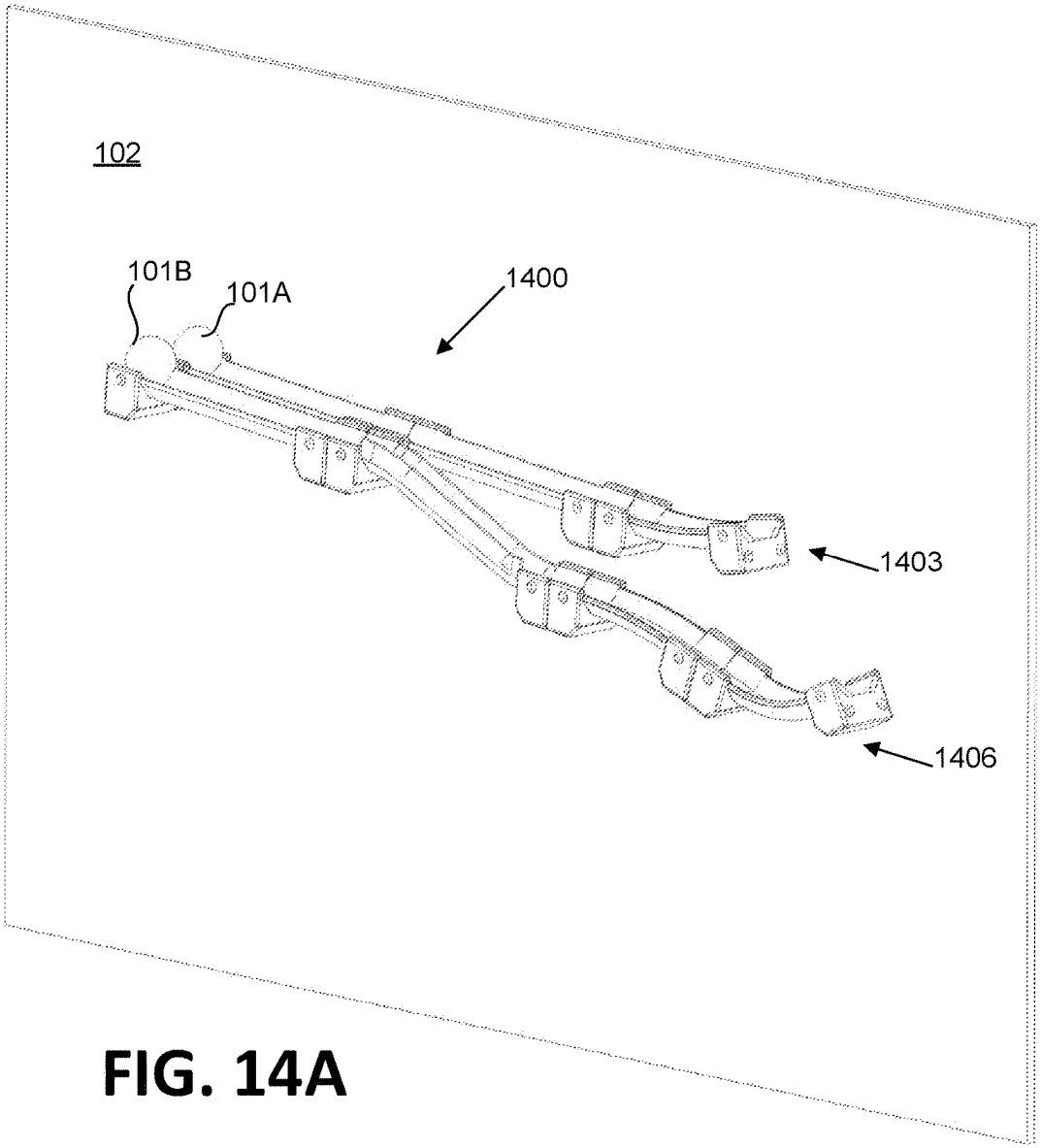
Figure 14C:
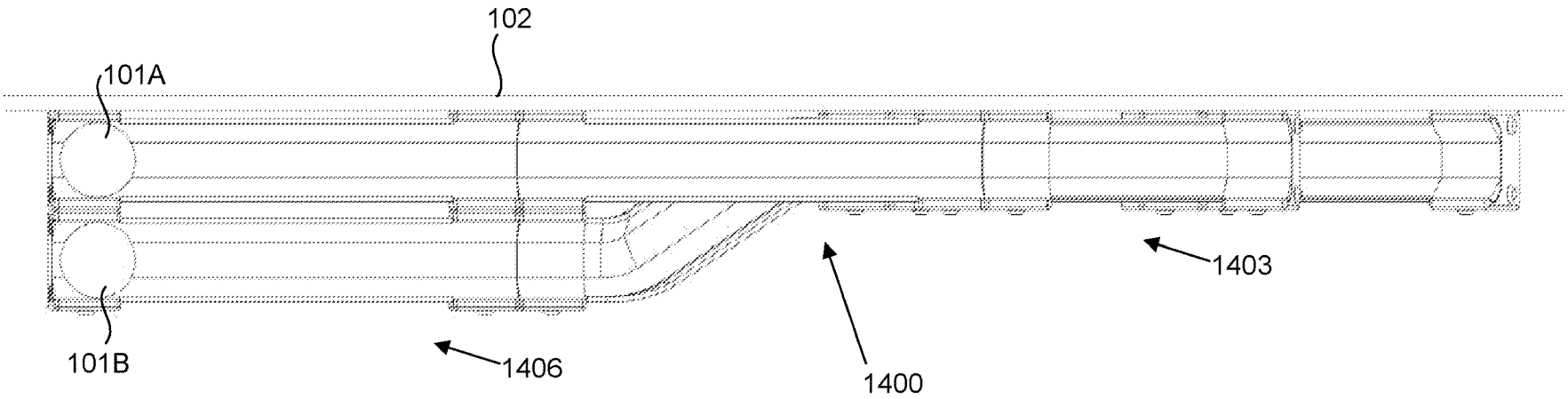

FIGS. 14A, 14B, 14C are perspective, side, and top views, respectively, of a side-by-side track assembly 1400 using magnets on two sides of magnetic connectors according to various embodiments. The side-by-side track assembly 1400 may include a first track assembly 1403 magnetically attached to the flat ferromagnetic metal sheet 102 (or to a ferromagnetic metallic vertical surface) and a second track assembly 1406 attached to the first track assembly 1403. In some embodiments, as illustrated in FIGS. 14A-14C, the second track assembly 1406 may also, in part, be attached to the flat ferromagnetic metal sheet 102, e.g., by way of one of the track segments being contoured to bend inwardly from an outer position of the second track assembly 1406 to an inner position of the first track assembly. In this way, the first track assembly 1403 and the second track assembly 1406 may be built in parallel to create a set of racetracks for racing a first ball 101A against a second ball 101B. The first track assembly 1403 and the second track assembly 1406 may, of course, be built to be much longer and include many more pieces such as illustrated in FIG. 1.

Figure 15A:
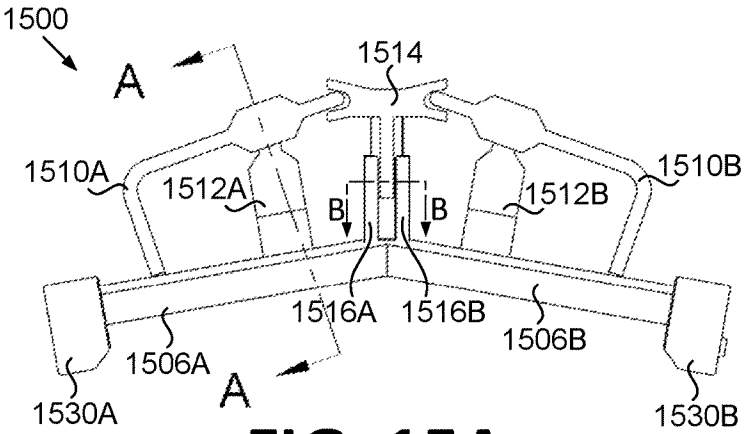
FIG. 15A is a side view of a double-starter track segment in a closed position and a pair of magnetic connectors according to an embodiment.
Figure 15B:
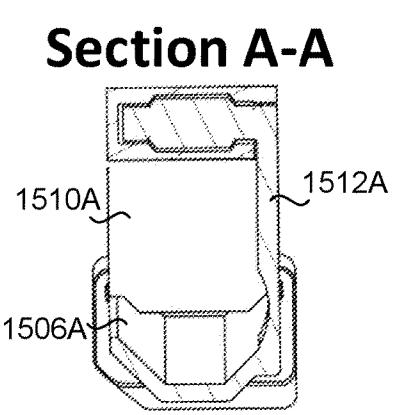
FIGS. 15B and 15C are cross-section views of the double-starter track segment illustrated in FIG. 15A along Section A-A and Section B-B, respectively, according to an embodiment.
Figure 15C:
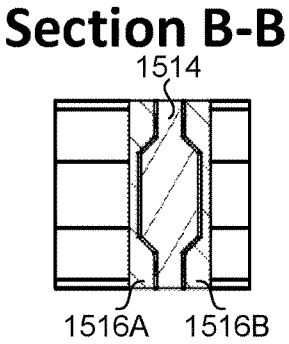
Figure 15D:
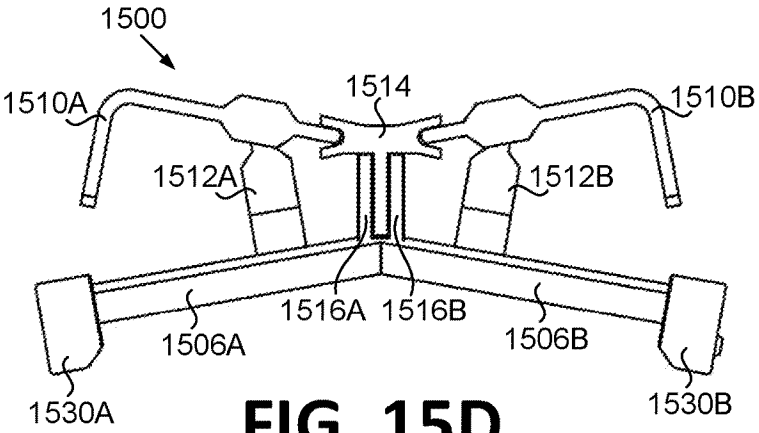
FIG. 15D is a side view of the double-starter track segment in an opened position and a pair of magnetic connectors according to an embodiment.
Figure 15E:
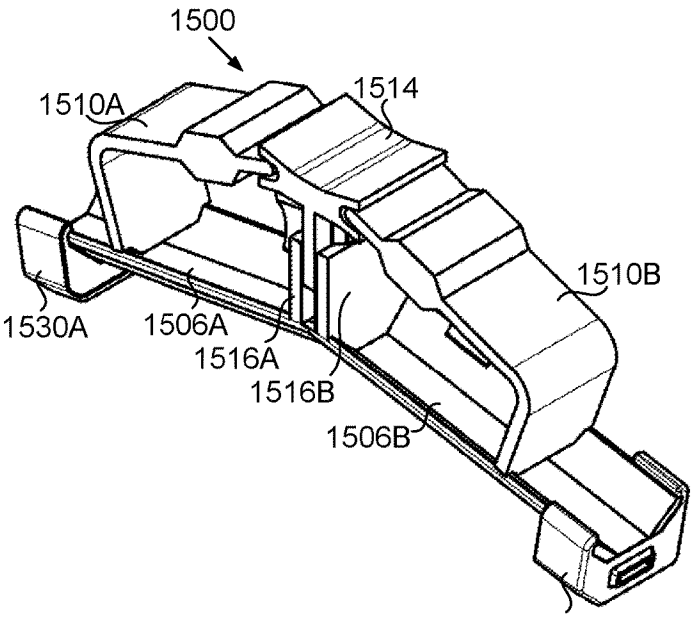
FIG. 15E is a perspective view of the double-starter track segment and a pair of magnetic connectors according to an embodiment.

FIG. 15A is a side view of a double-starter track segment 1500 and a pair of magnetic connectors according to an embodiment. For example, the pair of magnetic connectors can include a ninth connector 1530A and a tenth connector 1530B. FIGS. 15B and 15C are cross-section views of the double-starter track segment 1500 illustrated in FIG. 15A along Section A-A and Section B-B, respectively, according to an embodiment. FIG. 15D is a side view of the double-starter track segment 1500 and pair of magnetic connectors in an opened position according to an embodiment. FIG. 15E is a perspective view of the double-starter track segment 1500 and pair of magnetic connectors according to an embodiment.

As the track components illustrated in FIGS. 15A-15E have similar features to those already discussed, particular mention is made of different or additional features. In some embodiments, the double-starter track segment 1500 includes track segments 1506A and 1506B (similar to the other track segments discussed herein), starter gates 1510A and 1510B, gate supports 1512A and 1512B, starter yoke 1514, and yoke guides 1516A and 1516B. The starter gates 1510A and 1510B may have an opened position, as shown in FIG. 15A, and a closed position, as shown in FIG. 15D. The starter gates 1510A and 1510B may be rotationally coupled to gate supports 1512A and 1512B respectively. Starter gates 1510A-B may also be permanently coupled to gate supports 1512A-B in such a way as to prevent starter gates 1510A-B from sliding off the end of gate supports 1512A-B.

In some embodiments, the double-starter track segment 1500 is manufactured using 3D printing. The layers of the double-starter track segment 1500 can be laid down in such a way that simultaneously forms the permanent, rotated coupling between the starter gates 1510A-B and the gate supports 1512A-B, respectively.

In some embodiments, the double-starter track segment 1500 transitions from a closed position to an opened position by applying a downward force to the starter yoke 1514. The starter yoke 1514 may be coupled to the ends of the starter gates 1510A-B such that the linear motion of the starter yoke 1514 is translated into rotational motion of the starter gates 1510A-B, which are lifted up above the track segments 1506A and 1506B, respectively. Thus, actuation of the starter yoke 1514 may allow each starter gate 1510A and 1510B to transition from a closed position to an opened position at the same speed. When both starter gates 1510A and 1510B are lifted up, two balls (not shown) may start rolling down track segments 1506A and 1506B, respectively, at the same time. In this way, the starter yoke 1514 may be actuated to start a race between the two balls.

The starter yoke 1514 may be slidably coupled to the yoke guides 1516A and 1516B in such a way that the starter yoke 1514 can move vertically between yoke guides 1516A and 1516B. For example, the starter yoke 1514 may include a pair of rectangular sidewalls that move within the yoke guides 1516A and 1516B, respectively. In some embodiments, the starter yoke 1514 and the yoke guides 1516A-B are 3D-printed in place, e.g., and are thus formed as a single piece with mutually moving structures. Accordingly, assembly time to put the starter yoke 1514 in between the yoke guides 1516A-B and simultaneously couple the starter yoke 1514 to the ends of the starter gates 1510A-B is avoided with 3D printed. In some embodiments, because the starter yoke 1514 is also coupled to the ends of starter gates 1510A-B, the starter yoke 1514 may be permanently coupled between yoke guides 1516A-B such that the starter yoke 1514 cannot be separated from the double-starter track segment 1500.

FIG. 15B is a cross-section view of the double-starter track segment 1500 illustrated in FIG. 15A along Section A-A according to an embodiment. FIG. 15B shows an example of permanent, rotated coupling of the starter gate 1510A to the gate support 1512A and relative to the track segment 1506A. FIG. 15C is a cross-section view of the double-starter track segment 1500 illustrated in FIG. 15A along Section B-B according to an embodiment. FIG. 15C shows an example coupling of the starter yoke 1514 between the yoke guides 1516A and 1516B.

Figure 16D:
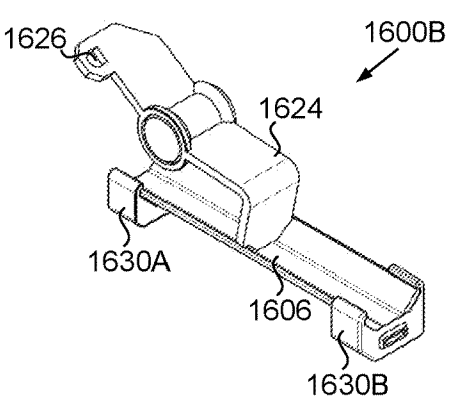
FIG. 16D is a perspective view of the gate track segment in a closed position and a pair of magnetic connectors according to an embodiment.
Figure 16E:
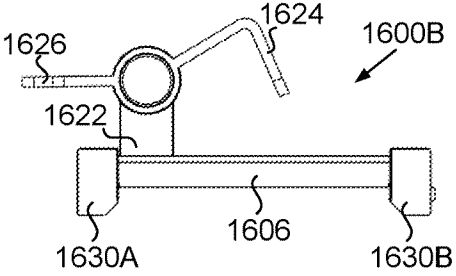
FIG. 16E is a side view of the gate track segment in an opened position and a pair of magnetic connectors according to an embodiment.
Figure 16A:
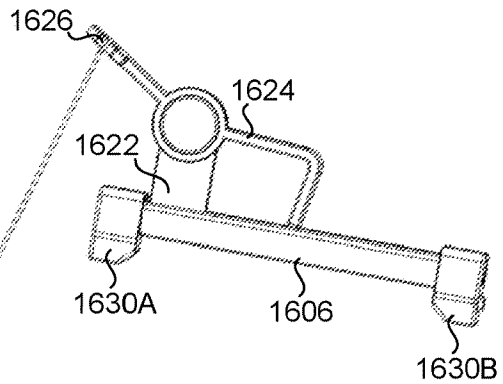
FIG. 16A is a side view of a gate actuator track segment that interacts with a gate track segment according to an embodiment.
Figure 16A:
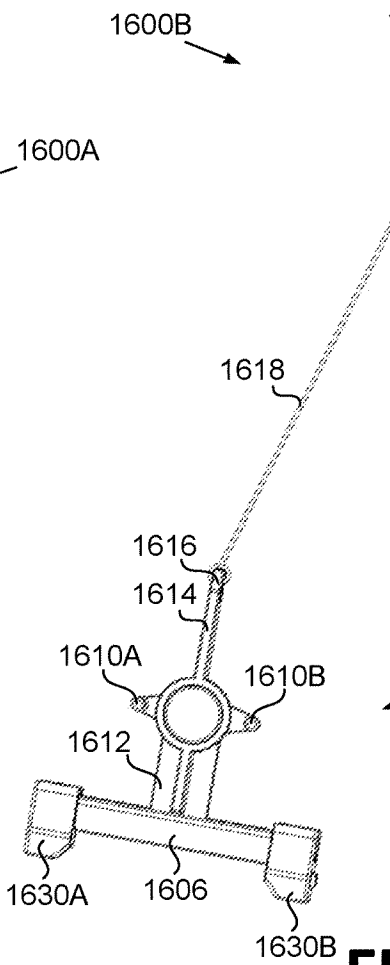
Figure 16B:
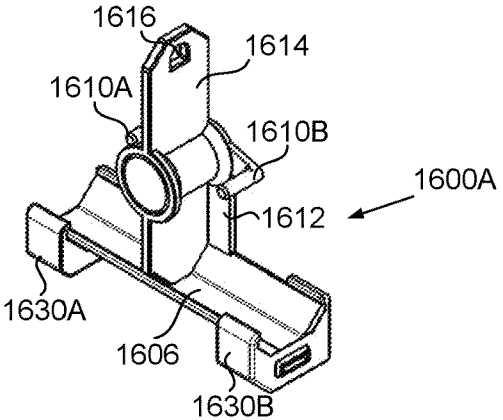
FIG. 16B is a perspective view of the gate actuator track segment in a closed position and a pair of magnetic connectors according to an embodiment.
Figure 16C:
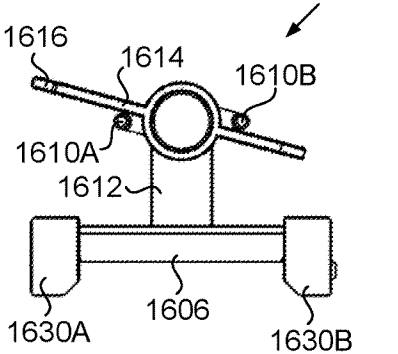
FIG. 16C is a side view of the gate actuator track segment in an opened position and a pair of magnetic connectors according to an embodiment.

FIG. 16A is a side view of a gate actuator track segment 1600A that interacts with a gate track segment 1600B according to an embodiment. The gate actuator track segment 1600A and the gate track segment 1600B may include a pair of magnetic connectors. The pair of magnetic connectors can include an eleventh connector 1630A and a twelfth connector 1630B. FIG. 16B is a perspective view of the gate actuator track segment 1600A in a closed position and a pair of magnetic connectors 1630A and 1630B according to an embodiment. FIG. 16C is a side view of the gate actuator track segment 1600A in an opened position and a pair of magnetic connectors 1630A and 1630B according to an embodiment. FIG. 16D is a perspective view of the gate track segment 1600B in a closed position and a pair of magnetic connectors 1630A and 1630B according to an embodiment. FIG. 16E is a side view of the gate track segment 1600B in an opened position and a pair of magnetic connectors 1630A and 1630B according to an embodiment.

As the track components illustrated in FIGS. 16A-16E have similar features to those already discussed, particular mention is made of different or additional features. In some embodiments, the gate actuator track segment 1600A includes a track segment 1606 (similar to the other track segments discussed herein), a set of rotational stops 1610A and 1610B, an actuator support 1612, and an actuator 1614 such as a lever. The actuator 1614 may have a closed position, as shown in FIG. 16B, and an opened position, as shown in FIG. 16C. The actuator 1614 may be rotationally coupled to the actuator support 1612. The actuator 1614 may also have an attachment point 1616 that is connected to an attachment point 1626 of the gate track segment 1600B by a connector 1618. The connector 1618 may be a string, a cord, a wire, a chain, a rod, or the like.

In some embodiments, the gate track segment 1600B includes the track segment 1606 (similar to the other track segments discussed herein), a gate support 1622, and a gate 1624. The gate 1624 may have a closed position, as shown in FIG. 16D, and an opened position, as shown in FIG. 16E. The gate 1624 may be rotationally coupled to the gate support 1622. As mentioned above, the gate may have an attachment point 1626.

In some embodiments, the gate actuator 1614 and the gate 1624 are coupled to the actuator support 1612 and the gate support 1622, respectively, using a press-fit connection. In some embodiments, the gate actuator track segment 1600A transitions from the closed position to the opened position by applying a force to the surface of the lower end of the actuator 1614. For example, the force may be applied to the actuator 1614 by a first ball (not shown) rolling down the track segment 1606 of the gate actuator track segment 1600A. The actuator 1614 may rotate until contacting the rotational stops 1610A-B.

In some embodiments, the gate track segment 1600B transitions from the closed position to the opened position when a force is applied to the surface of the lower end of the actuator 1614. The gate 1624 may be connected to the gate actuator 1614 by the connector 1618. The rotation of gate actuator 1614 may cause gate 1624 to rotate (e.g., lift) concurrently with the rotation of the gate actuator 1614. When the gate 1624 is lifted, a second ball (not shown) may start rolling down the track segment 1606 of the gate track segment 1600B.

FIG. 17A is a perspective view of a light switcher track segment 1700 and a pair of magnetic connectors according to an embodiment. For example, the pair of magnetic connectors can include a thirteenth connector 1730A and a fourteenth connector 1730B. FIG. 17B is a perspective view of a light switcher track segment 1700 and a pair of magnetic connectors 1730A and 1730B with a light switcher dropper 1712 according to an embodiment. FIG. 17C is a cross-section view of the light switcher dropper 1712 illustrated in FIG. 17B along Section B-B according to an embodiment. FIG. 17D is a perspective view of a toggle switch actuator 1720 according to an embodiment. FIG. 17E is a perspective view of a rocker switch actuator 1730 according to an embodiment.

As the track components illustrated in FIGS. 17A-17B and FIGS. 17F-17G have similar features to those already discussed, particular mention is made of different or additional features. In some embodiments, the light switcher track segment 1700 includes a track segment 1706 (similar to the other track segments discussed herein), a light switcher dropper support 1710, and a light switcher dropper 1712. In some embodiments, the light switcher dropper may include an attachment point 1714 and a ridged cutout 1716 as shown in FIG. 17C. The light switcher dropper support 1710 may include a group of ridges. The ridged cutout 1716 of the light switcher dropper 1712 may include a group of channels that are sized to receive the group of ridges of the light switcher dropper support 1710. The ridged cutout 1716 may have a group of channels that are sized to receive the group of ridges of the light switcher dropper support 1710 on both an upper and a lower surface, allowing the light switcher dropper 1712 to rest on the light switcher dropper support 1710 in multiple orientations.

With additional reference to FIG. 17D, in some embodiments, the toggle switch actuator 1720 includes a mounting surface 1722, an attachment point 1724, a set of female hinge pieces 1726A and 1726B, and a set of male hinge pieces 1728A and 1728B. In some embodiments, the female hinge pieces 1726A-B and the male hinge pieces 1728A-B are similar to the female portion 1114 and the male portion 1112, respectively, of the hinge 1110, which is illustrated in FIG. 11B. For example, the male hinge pieces 1728A-B can rotationally move inside of the female hinge pieces 1726A-B of the toggle switch actuator 1720. With additional reference to FIG. 17E, in some embodiments, the rocker switch actuator 1730 includes a mounting surface 1732, an attachment point 1734, and an attachment point extender 1736.

Figure 17G:
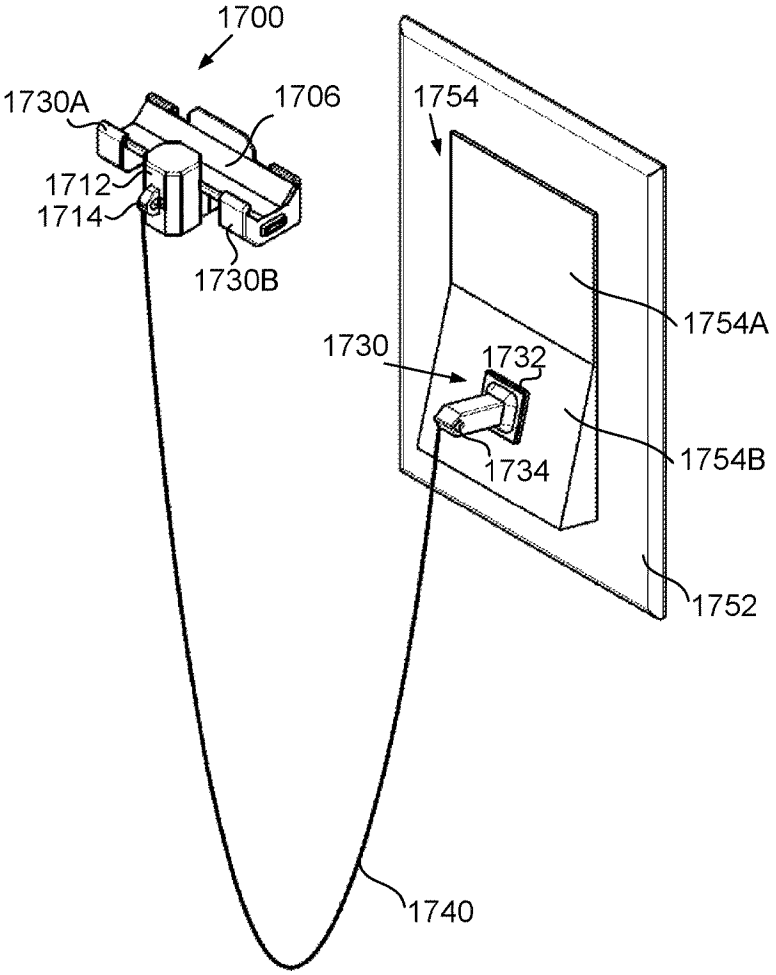
FIG. 17G is a perspective view of a light switcher track segment with a light switcher dropper connected to a rocker switch actuator mounted to a rocker light switch according to an embodiment.
Figure 17F:
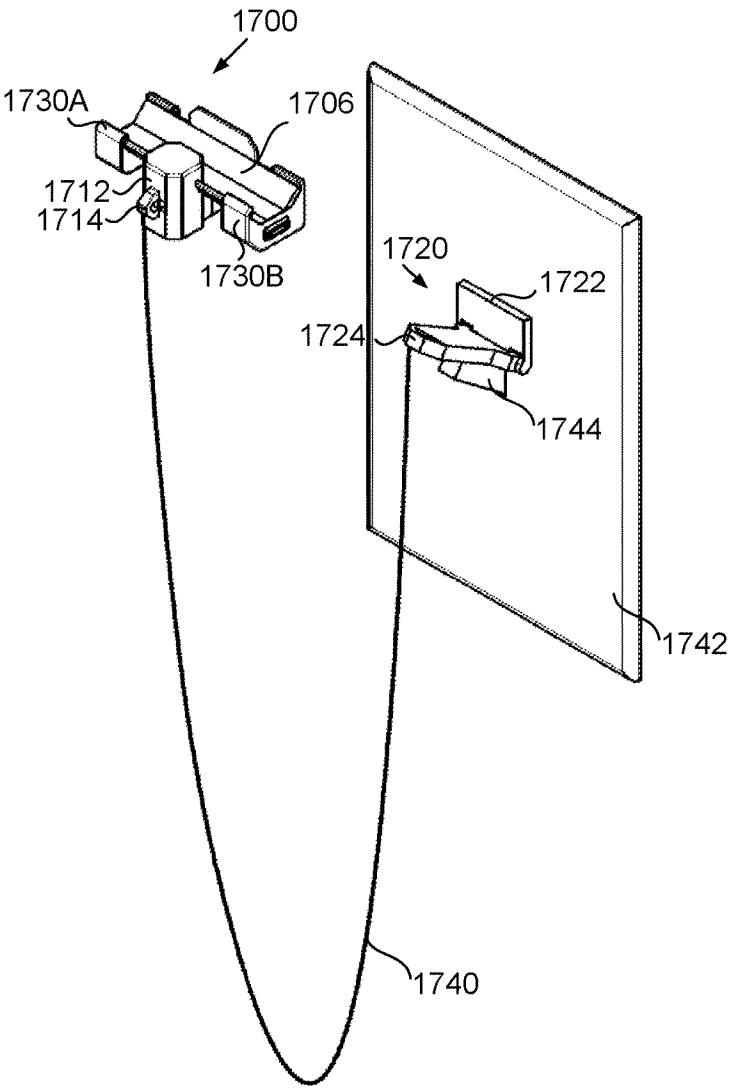
FIG. 17F is a perspective view of a light switcher track segment with a light switcher dropper connected to a toggle switch actuator mounted to a toggle light switch according to an embodiment.

FIG. 17F is a perspective view of a light switcher track segment 1700 with a light switcher dropper 1712 connected to a toggle switch actuator 1720 mounted to a toggle light switch 1742 according to an embodiment. In some embodiments, the attachment point 1714 of the light switcher dropper 1712 is connected to the attachment point 1724 of the toggle switch actuator 1720 by a connector 1740. The connector 1740 may be a string, a cord, a wire, a chain, or the like. The mounting surface 1722 of the toggle switch actuator 1720 may be attached to the toggle light switch 1742 just above the light toggle switch 1744, for example.

FIG. 17G is a perspective view of a light switcher track segment 1700 with a light switcher dropper 1712 connected to a rocker switch actuator 1730 mounted to a rocker light switch 1752 according to an embodiment. In some embodiments, the attachment point 1714 of the light switcher dropper 1712 is connected to the attachment point 1734 of the rocker switch actuator 1730 by the connector 1740 (or a similar connector). The mounting surface 1732 of the rocker switch actuator 1730 may be attached to the lower surface 1754B of a light rocker switch 1754. In another embodiment, the mounting surface 1732 of the rocker switch actuator 1730 may be attached to the upper surface 1754A of the light rocker switch 1754.

In some embodiments, the light switcher dropper 1712 rests on the light switcher dropper support 1710 and is attached to a light switch actuator (e.g., the toggle switch actuator 1720 or the rocker switch actuator 1730). When a ball (not shown) rolls down the track segment 1706, the ball may contact the light switcher dropper 1712 with sufficient force to displace the light switcher dropper 1712 from the light switcher dropper support 1710 causing the light switcher dropper 1712 to fall. As the light switcher dropper 1712 falls, the light switch dropper 1712 may actuate the connected light switch actuator, causing the light switch (e.g., light toggle switch or light rocker switch) to toggle positions.

More specifically, the light switch dropper 1712 may pull the attachment point 1724 of the toggle switch actuator 1720 downward, which causes the light toggle switch 1744 to switch to a downward position. Further, the light switch dropper 1712 may pull the attachment point 1734 of the rocker switch actuator 1730 downward, which causes the light rocker switch 1754 to switch to a downward position. The downward position may be the OFF position or the ON position depending on implementation and state of the light toggle switch or light rocker switch before being switched downward.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims may generally be construed to mean "one or more" unless specified otherwise or clear from context to be directed to a singular form. Moreover, use of the term "an implementation" or "one implementation" or "an embodiment" or "one embodiment" or the like throughout is not intended to mean the same implementation or embodiment unless described as such. One or more implementations or embodiments described herein may be combined in a particular implementation or embodiment. The terms "first," "second," "third," "fourth," or the like as used herein are meant as labels to distinguish among different elements and may not necessarily have an ordinal meaning according to their numerical designation. When the term "about" or "approximately" is used herein, this is intended to mean that the nominal value presented is precise within ±10%.

In the foregoing specification, embodiments of the disclosure have been described with reference to specific example embodiments thereof. It will be evident that various modifications can be made thereto without departing from the broader spirit and scope of embodiments of the disclosure as set forth in the following claims. The specification and drawings are, accordingly, to be regarded in an illustrative sense rather than a restrictive sense.

What is claimed is:

1. An assembly comprising:

a track segment including a channel for holding a rolling object;

a first connector attachable to a first end of the track segment, a front face of the first connector comprises a female registry feature, wherein the first connector is slidable onto the first end of the track segment;

a second connector attachable to a second end of the track segment, a front face of the second connector comprises a male registry feature that fits inside of the female registry feature, wherein the second connector is slidable onto the second end of the track segment; and wherein each of the first connector and the second connector comprises one or more magnets embedded therein that enable attaching the first connector and the second connector to a ferromagnetic surface.

2. The assembly of claim 1, wherein the first end of the track segment comprises a first half of a locking mechanism and the first connector comprises a second half of the locking mechanism that mates with the first half of the locking mechanism to lock the first connector to the track segment.

3. The assembly of claim 2, wherein the first half of the locking mechanism is a lock depression and the second half of the locking mechanism is a lock protrusion that fits at least partially inside of and is biased against the lock depression.

4. The assembly of claim 1, wherein the second end of the track segment comprises a first half of a locking mechanism and the second connector comprises a second half of the locking mechanism that mates with the first half of the locking mechanism to lock the second connector to the track segment.

5. The assembly of claim 1, wherein the one or more magnets comprises:

a first magnet embedded in the first connector; and a second magnet embedded in the second connector and having an opposite polarity to that of the first magnet, such that the second connector is attracted to another first connector, which is attached to a second track segment.

6. The assembly of claim 1, wherein the track segment comprises two or more sub-segments, wherein a first sub-segment has a female portion of a hinge and a second sub-segment has a male portion of a hinge, the male portion of the hinge rotatably attached to the female portion of the hinge.

7. The assembly of claim 1, wherein the track segment further comprises a funnel, the funnel being cone-shaped with a larger circumference near a surface of the track segment and a smaller circumference below the surface of the track segment.

* * * * *